US006980755B2

(12) United States Patent
Numagami et al.

(10) Patent No.: US 6,980,755 B2
(45) Date of Patent: Dec. 27, 2005

(54) RECYCLING METHOD FOR DEVELOPER SUPPLYING UNIT INCLUDING THE STEP OF DRIVING A FEEDING MEMBER IN A DIRECTION TO FEED DEVELOPER FROM A DEVELOPER SUPPLY PORT TO A DEVELOPER ACCOMMODATING PORTION

(75) Inventors: Atsushi Numagami, Hadano (JP); Kenji Matsuda, Numazu (JP); Akiyoshi Fujita, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/669,505

(22) Filed: Sep. 25, 2003

(65) Prior Publication Data

US 2004/0126131 A1 Jul. 1, 2004

(30) Foreign Application Priority Data

Sep. 30, 2002 (JP) ..... 2002/285469

(51) Int. Cl.[7] ..... G03G 15/00
(52) U.S. Cl. ..... 399/109
(58) Field of Search ..... 399/109

(56) References Cited

U.S. PATENT DOCUMENTS

| | | | | |
|---|---|---|---|---|
| 5,283,616 A | | 2/1994 | Numagami et al. | 355/245 |
| 5,500,714 A | | 3/1996 | Yashiro | 355/200 |
| 5,528,341 A | | 6/1996 | Shishido et al. | 355/200 |
| 5,585,895 A | | 12/1996 | Yashiro | 355/215 |
| 5,642,187 A | | 6/1997 | Nomura et al. | 399/111 |
| 5,650,841 A | | 7/1997 | Matsuda et al. | 399/111 |
| 5,790,923 A | | 8/1998 | Ogumga et al. | 399/106 |
| 5,920,753 A | | 7/1999 | Sasaki et al. | 399/111 |
| 5,966,566 A | | 10/1999 | Odagawa et al. | 399/109 |
| 5,966,568 A | | 10/1999 | Numagami et al. | 399/119 |
| 6,016,413 A | | 1/2000 | Yokoyama et al. | 399/113 |
| 6,088,561 A | * | 7/2000 | Kawamura et al. | 399/262 |
| 6,101,352 A | | 8/2000 | Hashimoto et al. | 399/119 |
| 6,131,007 A | | 10/2000 | Yamaguchi et al. | 399/111 |
| 6,151,459 A | | 11/2000 | Hashimoto et al. | 399/27 |
| 6,246,848 B1 | | 6/2001 | Morinaga et al. | 399/106 |
| 6,266,500 B1 | | 7/2001 | Numagami et al. | 399/104 |
| 6,272,299 B1 | | 8/2001 | Numagami et al. | 399/111 |

(Continued)

FOREIGN PATENT DOCUMENTS

| | | |
|---|---|---|
| EP | 1 096 330 | 5/2001 |
| EP | 1 184 742 | 3/2002 |
| JP | 9-81013 | 3/1997 |
| JP | 2000-147878 | 5/2000 |
| JP | 2001-125460 | 5/2001 |
| JP | 2001-125466 | 5/2001 |
| JP | 2001-125467 | 5/2001 |
| JP | 2001-125469 | 5/2001 |
| JP | 2002-189399 | 7/2002 |

*Primary Examiner*—Quana Grainger
(74) *Attorney, Agent, or Firm*—Fitzpatrick, Cella, Harper & Scinto

(57) ABSTRACT

A recycling method is for a developer supply unit for supplying a developer to developing device for developing an electrostatic latent image formed on an electrophotographic photosensitive member. The developer supply unit is detachably mountable to a main assembly of an electrophotographic image forming apparatus and includes a developer accommodating portion for accommodating the developer, a developer supply port for supplying the developer to the developing means and a feeding member for feeding the developer to the developer supply port from the developer accommodating portion. The method includes an injection step of injecting the developer through the developer supply port; and driving step of driving the feeding member in a direction for feeding the developer from the developer supply port to the developer accommodating portion, by which the developer is fed from the developer supply port to fill the developer accommodating portion with the developer.

10 Claims, 18 Drawing Sheets

U.S. PATENT DOCUMENTS

| | | | | |
|---|---|---|---|---|
| 6,278,853 | B1 | 8/2001 | Ban et al. | 399/109 |
| 6,324,370 | B1 | 11/2001 | Isobe et al. | 399/258 |
| 6,397,025 | B1 | 5/2002 | Higeta et al. | 399/109 |
| 6,442,359 | B1 | 8/2002 | Numagami et al. | 399/111 |
| 6,463,233 | B2 | 10/2002 | Kojima et al. | 399/111 |
| 6,470,163 | B1 * | 10/2002 | Minagawa | 399/256 |
| 6,473,577 | B1 | 10/2002 | Higeta et al. | 399/109 |
| 6,564,029 | B2 | 5/2003 | Kojima et al. | 399/258 |
| 6,608,980 | B2 | 8/2003 | Murayama et al. | 399/111 |
| 2002/0106213 | A1 | 8/2002 | Higeta et al. | 399/104 |
| 2002/0141788 | A1 | 10/2002 | Matsuda et al. | 399/260 |

* cited by examiner

RECYCLING METHOD FOR DEVELOPER SUPPLYING UNIT INCLUDING THE STEP OF DRIVING A FEEDING MEMBER IN A DIRECTION TO FEED DEVELOPER FROM A DEVELOPER SUPPLY PORT TO A DEVELOPER ACCOMMODATING PORTION

FIELD OF THE INVENTION AND RELATED ART

The present invention relates to a method for remanufacturing a developer supplying unit removably mountable in the image assembly of an electrophotographic image forming apparatus.

Here, an electrophotographic image forming apparatus is an apparatus which forms an image on recording medium with the use of an electrophotographic image-formation method. It includes, for example, various types of electrophotographic copying machines, electrophotographic printers (laser beam printers, LED printers, etc.), facsimile machines, word processors, etc.

A developer supplying unit is a unit used for supplying a developing means with developer and is removably mountable in the main assembly of an electrophotographic image forming apparatus.

Toner has long been used as the developer for an electrophotographic image forming apparatus, such as an electrophotographic copying machine, a printer, etc. It is held in a toner supply container (developer supplying apparatus) having a toner storage portion and a toner outlet portion. A user uses a toner supply container by mounting it into an electrophotographic image forming apparatus.

When the amount of the toner in a toner supply container has been reduced to a critical level due to consumption, this toner supply container can be replaced with a remanufactured toner supply container, that is, a used toner supply container refilled with toner, or a brand-new toner supply container, thereby simplifying the toner-supplying operation.

Also long employed in the field of an electrophotographic image forming apparatus is a process-cartridge system, according to which an electrophotographic photoconductive member, and a single or plurality of processing means among a charging means, a developing means, a cleaning means, etc., are integrally disposed in a cartridge removably mountable in the main assembly of an image forming apparatus.

A process-cartridge system makes it possible for a user himself to carry out image-forming-apparatus maintenance, without relying on a service person, drastically increasing the operability of an image forming apparatus. Thus, a process-cartridge system has been widely used in the field of an electrophotographic image forming apparatus.

Further, it has been a common practice to make a process cartridge and a toner supply container independent from each other, so that they can be individually replaced as necessary.

There are several designs for a toner supply container. According to one of the widely known toner-supply-container designs, a toner supply container is provided with a toner outlet having a connective portion with which the toner supply container is connected to, for example, a developing means or a toner buffer, and a movable cover for covering the toner outlet. Thus, as a toner supply container is inserted into the image forming apparatus main assembly, the cover is moved to expose the toner outlet, making it possible for the toner to be supplied to a developing means, a toner buffer, or the like.

Regarding the filling of the above-described toner supply container, the toner supply container is also provided with a toner inlet, which is different from the aforementioned toner outlet. Thus, toner is filled into the toner supply container through the toner inlet. After the filling of the toner supply container, the toner inlet is plugged with a toner cap to prevent the toner from leaking.

In recent years, environmental problems have been scrutinized, increasing the need for recycling. In this kind of social climate, it has become highly important to reuse used toner supply containers.

Therefore, various methods have been proposed for remanufacturing used toner supply containers, used process cartridges, etc. (Japanese Laid-open Patent Applications 9-081013, 2000-147878, 2001-125460, 2001-125466, 2001-125467, 2001-125469, 2002-189399, etc.).

SUMMARY OF THE INVENTION

The primary object of the present invention is to provide a simple and reliable developer-supplying-unit remanufacturing method which makes it possible to remanufacture a developer supplying unit by refilling the developer supplying unit with toner.

Another object of the present invention is to provide a developer-supplying-unit remanufacturing method which makes it possible to remanufacture a developer supplying unit by refilling the developer supplying unit with toner without damaging the developer supplying unit.

Another object of the present invention is to provide a developer-supplying-unit remanufacturing method which makes it possible to remanufacture a developer supplying unit by refilling the developer supplying unit with toner without removing the components from the developer supplying unit.

Another object of the present invention is to provide a developer-supplying-unit remanufacturing method which makes it possible to remanufacture a developer supplying unit by refilling the developer supplying unit with toner in a short time.

Another object of the present invention is to provide a method for remanufacturing a developer supplying unit which is for supplying with toner a developing means for developing an electrostatic latent image formed on an electrophotographic photoconductive member. The developer supplying unit is removably mountable in the main assembly of an electrophoto-graphic image forming apparatus, and comprises a developer storage portion for storing developer, a developer outlet for supplying the developing means with developer, and a conveying member for conveying developer from the developer storage portion to the developer outlet. The method comprises a toner pouring process in which toner is poured through the developer outlet, and a driving process in which the conveying member is driven in a direction to convey the poured toner from the developer outlet to the developer storage portion, and fills the developer supplying unit with developer by conveying developer from the developer outlet to the developer storage portion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. In the following descriptions, however, the measurements, materials, and shapes of the structural components, in the embodiments, and their positional relationships, etc., are not intended to limit the scope of the present invention, unless specifically noted.

Referring to FIGS. 1–16, the embodiments of the present invention will be described.

First, the electrophotographic color image forming apparatus in this embodiment of the present invention will be described with reference to the appended drawings. In the following descriptions of the embodiments, the lengthwise direction is a direction parallel to the axial line of an electrophotographic photoconductive drum (which hereinafter will be referred to as photoconductive drum 2). Further, with reference to the direction in which a cartridge is inserted into an electrophotographic image forming apparatus, the downstream side of the cartridge in the cartridge-insertion direction is considered to be the back side of the cartridge, whereas the downstream side of the cartridge in the direction in which a cartridge is pulled out of an electrophotographic image forming apparatus, that is, the upstream side of the cartridge in the cartridge-insertion direction is designated as the front side. The top and bottom sides of a cartridge are the top and bottom sides of the cartridge properly situated in the main assembly of an electrophotographic image forming apparatus.

[Description of General Structure of Image Forming Apparatus]

Figure 1:
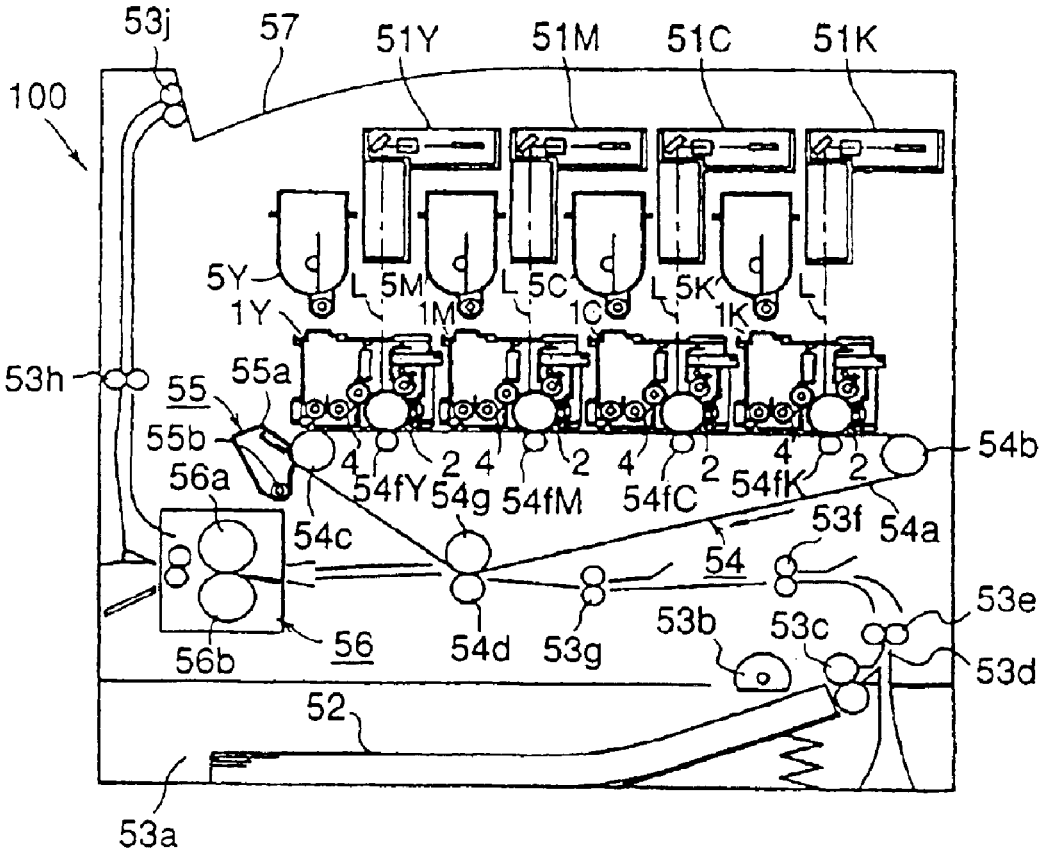
FIG. 1 is a vertical sectional view of the main assembly of the electrophotographic color image forming apparatus in the preferred embodiment of the present invention.

First, referring to FIG. 1, the general structure of a typical electrophotographic color image forming apparatus will be described. FIG. 1 is a drawing for describing the general structure of a color laser beam printer (which hereinafter may be simply referred to as image forming apparatus), that is, one form of an electrophotographic color image forming apparatus.

The image forming portion of this electrophotographic image forming apparatus 100 in this embodiment employs four process cartridges 1 (1Y, 1M, 1C, and 1K corresponding to yellow, magenta, cyan, and black color components, respectively). The image forming portion also has four exposing means (laser beam optical scanning system) (51Y, 51M, 51C, and 51K), which are disposed in parallel and are aligned in the horizontal direction. The four exposing means are located above the process cartridges 1 (1Y, 1M, 1C, and 1K), being roughly vertically aligned one for one with the four process cartridges 1.

Disposed below the above-described image forming portion is a feeding means for feeding a recording medium 52 into the main assembly, and an intermediary transfer unit 54 having an intermediary transfer belt 54*a* onto which a developer image formed on the photoconductive drum 2 is transferred, and a secondary transfer roller 54*d* for transferring the developer images on the transfer belt 54*a*, onto the recording medium 52.

The image forming apparatus is also provided with a fixing means 56 for fixing the toner images which have been transferred onto the recording medium 52, and discharge rollers 53*h* and 53*j* for discharging the recording medium 52 out of the image forming apparatus main assembly and accumulating it.

The recording medium 52 is, for example, a piece of recording paper, OHP sheet, fabric, or the like.

The image forning apparatus 100 in this embodiment is a cleanerless apparatus. Thus, the transfer residual toner, that is, the toner remaining on the photoconductive drum 2 after transfer is taken in by the developing means. Therefore, the process cartridge 1 is not provided with a cleaner dedicated to the recovery and storage of the transfer residual toner.

Next, the structures of the various portions of the image forming apparatus 100 will be described in detail in the logical order.

[Feeding Portion]

The feeding portion is a portion for conveying the recording medium 52 to the image forming portion. It essentially comprises: a feeding cassette 53*a* which holds a plurality of recording media 52; a feed roller 53*b*; a pair of retard rollers 53*c* for preventing two or more recording media 52 from being fed at the same time; a guide 53*d*; and a pair of registration rollers 53*g*.

The recording medium 2 is conveyed to the registration rollers 53*g* by the conveying rollers 53*e* and 53*f* while being guided by the guide 53*d*.

The feeding roller 53*b* is rotationally driven in synchronism with an image forming operation, taking the recording media 52, virtually one by one, out of the feeding cassette 53*a* and feeding them into the apparatus main assembly.

As the recording media 52 are fed into the apparatus main assembly, they are prevented by the retard rollers 53*c* from being fed at the same time. Then, the recording media 52 are conveyed to the registration rollers 53*g*, by way of the conveyance rollers 53*e* and 53*f*, while being guided by the conveyance guide 53*d*.

During an image forming operation, the registration rollers 53*g* repeat the sequence of being kept stationary for keeping a recording medium 52 on standby, and being rotated for conveying the recording medium 52 toward the intermediary transfer belt 54*a*, in order to align a toner image with the recording medium 52 during the subsequent transfer process.

Immediately after the release of the recording medium 52, the rotation of the registration rollers 53*g* is stopped, and the registration rollers 53*g* are again kept stationary. Then, the following recording medium 52 collides with the nip portion between the two registration rollers 53*g*, being thereby unslanted.

[Process Cartridge]

A process cartridge is a cartridge in which a charging means, and a developing meaning or cleaning means, are integrally disposed along with an electrophotographic photoconductive drum, and which is removably mountable in the main assembly of an electrophotographic image forming apparatus, or a cartridge in which at least one means among a charging means, a developing means, and a cleaning means, is integrally disposed along with an electrophotographic photoconductive drum, and which is removably mountable in the main assembly of an electrophotographic image forming apparatus. It also is a cartridge in which a minimum of a developing apparatus is integrally disposed along with an electrophotographic photoconductive drum, and which is removably mountable in the main assembly of an electrophotographic image forming apparatus. In this embodiment, the image forming apparatus 100 is of a cleanerless type, which will be described later. Thus, the process cartridges 1Y, 1M, 1C, and 1K for this image forming apparatus are cartridges in which a charging means and developing means are integrally disposed along with an electrophotographic photoconductive drum, and which are removably mountable in the main assembly of the image forming apparatus 100.

In each of the process cartridges 1Y, 1M, 1C, and 1K, a charging means and a developing means are integrally disposed around the peripheral surface of the photoconductive drum 2. These process cartridges 1 can be easily removed from the image forming apparatus 100, and are to be replaced at the end of the service life of the photoconductive drum 2.

As for the method for determining whether or not the service life of the process cartridge 1 has reached its end, the rotations of the photoconductive drum 2 are counted, and as the cumulative number of the rotations exceeds a predetermined value, a user is warned that the service life of the process cartridge 1 has reached its end.

The photoconductive drum 2 in this embodiment is an organic photoconductive member, the inherent polarity of which is negative. It comprises a hollow aluminum cylinder, as a base member 2*h*, with a diameter of approximately 30 mm, a layer of an ordinary photoconductive substance coated on the peripheral surface of the base member 2*h*, and a charge injection layer as an outermost layer coated on the photoconductive layer. It is rotationally driven at a predetermined process speed, which in this embodiment is approximately 117 mm/sec.

The charge injection layer is a coated layer of a mixture of insulating resin as binder, and microparticles of an electrically conductive substance, for example, Sn02, dispersed in the binder.

Figure 4:
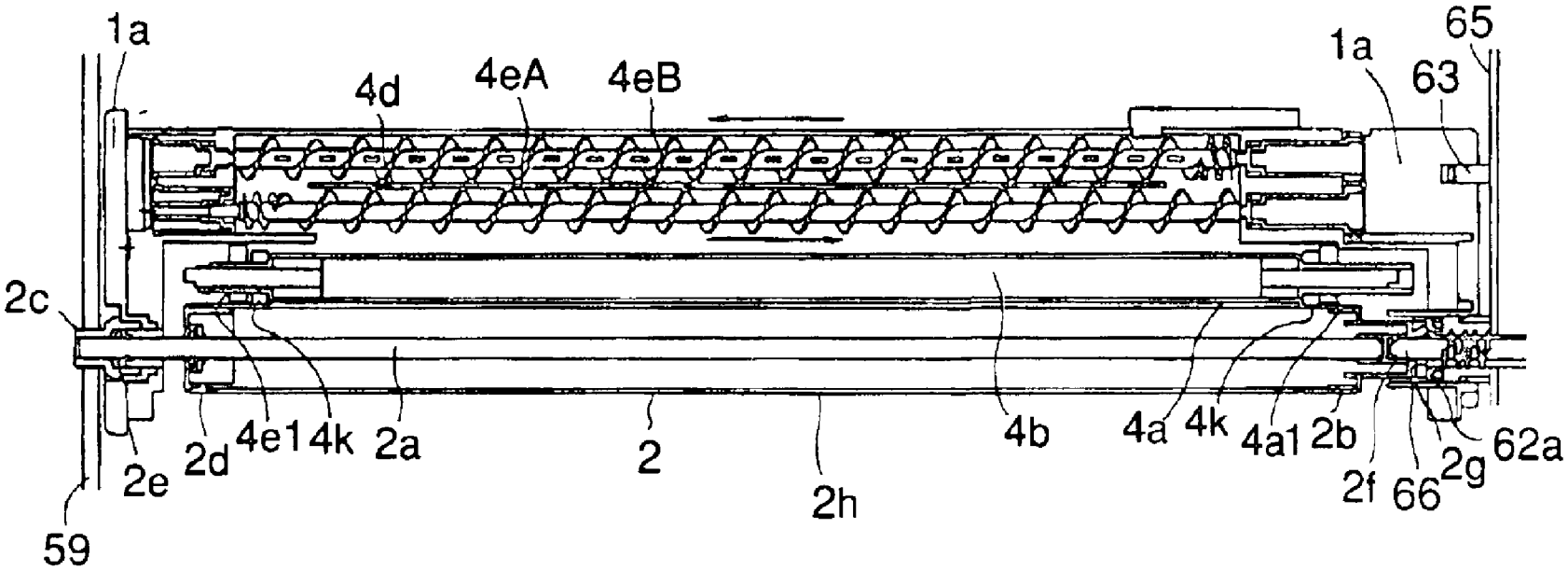
FIG. 4 is a horizontal, lengthwise sectional view of the process cartridge in the preferred embodiment of the present invention.

Referring to FIG. 4, the photoconductive drum 2 is provided with a drum flange 2*b*, which is solidly attached to the back end (right end in FIG. 4) of the base drum 2*h* of the photoconductive drum 2 in terms of the lengthwise direction of the photoconductive drum 2, and a drum flange 2*d*, which is solidly attached to the front end (left end in FIG. 4) of the base drum 2*h*, from which the photoconductive drum 2 is not driven. The photoconductive drum 2 is also provided with a drum shaft 2*a*, which penetrates the centers of the drum flanges 2*b* and 2*d*. The drum shaft 2*a* is connected to the flange 2*d* so that it rotates with the flange 2*d*, that is, the flange on the side from which the photoconductive drum 2 is not driven, which hereinafter will be referred to as non-driven flange 2*d*. The base drum 2*h*, the drum shaft 2*a*, the drum flange 2*b*, and the non-driven flange 2*d* are rotated together. In other words, the photoconductive drum 2 is rotated about the axis of the drum shaft 2*a*.

The front end portion of the drum shaft 2*a* is rotationally supported by a bearing 2*e*, which is solidly fixed to a bearing case 2*c*, which is solidly fixed to the frame 1*a* of the process cartridge 1.

[Charging Means]

Figure 2:
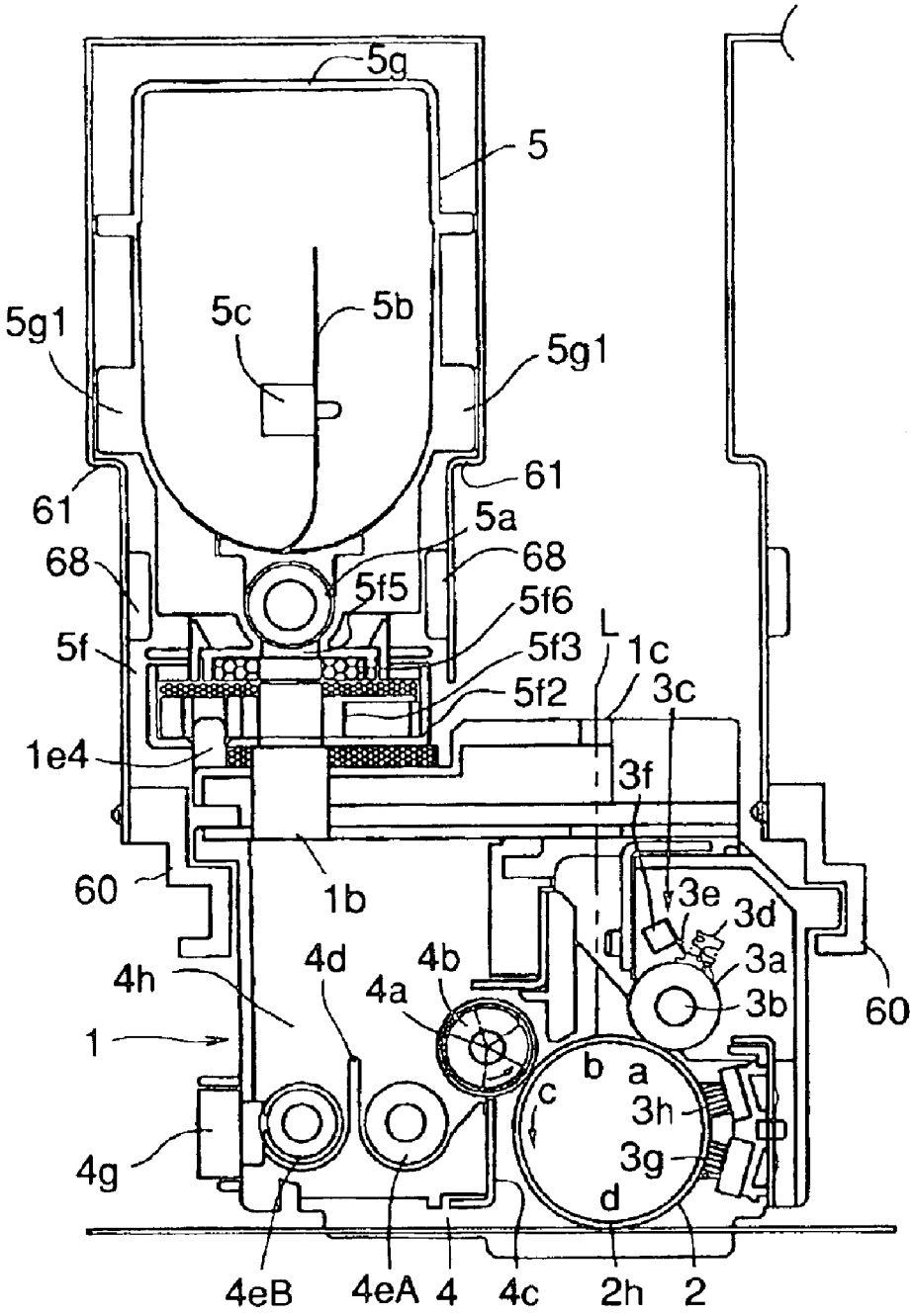
FIG. 2 is a vertical sectional view of the process cartridge and the toner supply container in the preferred embodiment of the present invention.

Referring to FIG. 2, the charging means in this embodiment employs one of the contact-type charging methods. It employs a charge roller 3*a* as a charging member. The charge roller 3*a* is rotatably supported by a pair of bearings (unshown), at the lengthwise end portions of its metallic core 3*b*. It is kept pressured toward the photoconductive drum by a pair of compression springs 3*d*; it is kept in contact with the peripheral surface of the photoconductive drum 2, so that a predetermined amount of contact pressure is maintained between the photoconductive drum 2 and the charge roller 3*a*. It is rotated by the rotation of the photoconductive drum 2.

Designated by a reference number 3*c* is a cleaning member for cleaning the charge roller 3*a*. The charge roller cleaning member 3*c* in this embodiment has a flexible cleaning film 3*e*, which extends in the lengthwise direction of the charge roller 3*a*, in parallel to the charge roller 3*a*. The cleaning film 3*e* is solidly fixed, by one of the long edges thereof, to a supporting member 3*f* which is reciprocally moved a predetermined distance in the lengthwise direction of the charge roller 3*a*. The cleaning film 3*e* is disposed so that the free long edge portion of the cleaning film 3*e* forms a contact nip against the peripheral surface of the charge roller 3*a*. Thus, as the supporting member 3*f* is reciprocally moved by an external driving means, the peripheral surface of the charge roller 3*a* is rubbed by the cleaning film 3*e*. As a result, the contaminants (minute particles of toner, external additive, etc.) adhering to the peripheral surface of the charge roller 3*a* are removed.

Incidentally, the image forming apparatus 100 in this embodiment is of a cleaner-less type. Next, the cleanerless system will be described.

[Cleanerless System]

Referring to FIG. 2, the outline of the cleanerless system of the image forming apparatus 100 in this embodiment will be described. The transfer residual toner, that is, the toner remaining on the photoconductive drum 2 after the aforementioned toner-image transfer is conveyed further by the subsequent rotation of the photoconductive drum 2 through the charging portion a and exposing portion b, and into the development portion c, in which the transfer residual toner is recovered (photoconductive drum is cleaned) by the developing means at the same time as a latent image on the photoconductive drum 2 is developed by the developing means.

Since the transfer residual toner on the peripheral surface of the photoconductive drum 2 is moved past the exposing portion b, the peripheral surface of the photoconductive drum 2 is exposed through the transfer residual toner thereon. However, the transfer residual toner is very small in quantity, not significantly affecting the exposing process.

Incidentally, in terms of polarity, the transfer residual toner is a mixture of normally charged toner particles and reversely charged toner particles (reversal toner particles), and, in terms of the amount of charge, it is a mixture of fully charged toner particles and insufficiently charged toner particles. It is possible that these reversely charged toner particles and insufficiently charged toner particles are likely to adhere to the charge roller 3*a*, contaminating thereby the charge roller 3*a*, beyond the permissible level, that is, seriously enough for the photoconductive drum 2 to be insufficiently charged.

In order to assure that the transfer residual toner on the peripheral surface of the photoconductive drum 2 is satisfactorily removed by the developing apparatus at the same time as a latent image on the peripheral surface of the photoconductive drum 2 is developed by the developing apparatus, it is necessary that the transfer residual toner on the peripheral surface of the photoconductive drum 2, which is to be conveyed to the developing portion c, is positive in polarity, and also that the amount of electrical charge of the transfer residual toner is equal to a value which makes it possible to develop the electrostatic latent image on the photoconductive drum 2 by the developing apparatus. The reversely charged toner particles, and the insufficiently charged toner particles, cannot be removed from the peripheral surface of the photoconductive drum 2 by the developing means, and therefore, cannot be recovered, causing therefore the formation of an image of poor quality.

In recent years, user needs have diversified. One of the diversified user needs is to print an image with a higher printing ratio, for example, a photographic image, which requires a continuous long printing operation, generating all at once a substantial amount of transfer residual toner, thereby exacerbating the above-described problem.

In this embodiment, therefore, a transfer residual toner distributing means 3*g* (means for erasing a residual developer image) for evenly distributing the transfer residual toner particles on the photoconductive drum 2, is disposed on the downstream side of the transfer portion d, in terms of the rotational direction of the photoconductive drum 2. Further, in order to make all the transfer residual toner particles normally charged, that is, negatively charged, a toner charge controlling means 3*h* for charging the reversely charged toner particles to a negative polarity, is disposed between the downstream side of the transfer residual toner distributing means 3*g*, and the upstream side of the charging portion a, in terms of the rotational direction of the photoconductive drum 2.

With the provision of the transfer residual toner distributing means 3*g*, the transfer residual toner particles, which are remaining, in a certain pattern, on the photoconductive drum 2, are conveyed from the transfer portion d to the toner charge controlling means 3*h*, and are evenly distributed across the peripheral surface of the photoconductive drum 2, thereby destroying the pattern in which they have been adhering to the peripheral surface of the photoconductive drum 2, even if their amount is substantial. Therefore, the problem that the toner particles concentrate on certain portions of the toner charge controlling means 3*h* is eliminated, assuring thereby that the reversely charged residual toner particles are normally charged by the toner charge controlling means 3*h* so that all of the transfer residual toner particles become normal in polarity. Therefore, the adhesion of the transfer residual toner to the charge roller 3*a* is effectively prevented, and also the creation of a ghost image reflecting the pattern, in which the transfer residual toner particles remain on the photoconductive drum 2, is prevented.

The transfer residual toner distributing means 3*g* and the toner charge controlling means 3*h*, in this embodiment, are in the form of a brush with a proper degree of electrical conductivity, and are placed in contact with the photoconductive drum 2, with their brush portions in contact with the peripheral surface of the photoconductive drum 2.

These means 3*g* and 3*h* are structured so that they are moved (reciprocally) in the lengthwise direction of the photoconductive drum 2, by an unshown driving force source. With the provision of this structural arrangement, the transfer residual toner distributing means 3*g* and the toner charge controlling means 3*h* do not remain in contact with the same ranges of the peripheral surface of the photoconductive drum 2. Therefore, it does not occur that a given portion of the peripheral surface of the photoconductive drum 2 is always contacted by the same portion of the toner charge controlling means 3*h*. Thus, even if the irregularity in electrical resistance across the toner charge controlling means 3*h* makes some portions of the toner charge controlling means 3*h* excessive in charging performance, and the other portions insufficient in charging performance, the problem that the excessively charged transfer residual toner particles adhere to certain areas of the peripheral surface of the photoconductive drum 2, and/or the problem that the insufficiently charged transfer residual toner particles adhere to certain areas of the peripheral surface of the charge roller 3*a*, are prevented or mitigated.

[Exposing Means]

In this embodiment, the aforementioned photoconductive drum 2 is exposed by a laser exposing means. More specifically, as image formation signals are sent to the exposing means from the image forming apparatus 100, a beam of laser light L is projected from the exposing means, while being modulated with the image formation signals, onto the photoconductive drum 2, in a manner to scan the uniformly charged portion of the peripheral surface of the photoconductive drum 2, selectively exposing numerous points on the uniformly charged portion of the peripheral surface of the photoconductive drum 2. As a result, an electrostatic latent image in accordance with the image formation information is formed on the peripheral surface of the photoconductive drum 2.

Referring to FIG. 1, the laser exposing means comprises: a solid laser element (unshown), a polygon mirror 51*a*, a focusing lens 51*b*, a reflection mirror 51*c*, etc.

In operation, the solid laser element is turned on and off by an optical signal generating device (unshown), in response to the inputted image formation signals. The beam of laser light L irradiated from the solid laser element is converted by a collimator lens system (unshown) into a virtually parallel beam of light, and is projected onto the polygon mirror 51*a*, which is being rotated at a high peripheral velocity. As a result, the parallel beam of light is oscillated in a scanning manner. Then, it is further projected by way of the focusing lens 51*b* and reflection mirror 51*c*, forming an oscillating spot of light on the peripheral surface of the photoconductive drum 2.

Thus, as the spot of light oscillates, the peripheral surface of the photoconductive drum 2 is exposed in the primary scanning direction, and as the photoconductive drum 2 is rotated, it is exposed in the secondary scanning direction. As a result, numerous points on the peripheral surface of the photoconductive drum 2 are exposed or remain unexposed in such a manner that the distribution of the exposed and unexposed points reflects the image formation signal sequence. In other words, the points (exposed points) with the reduced potential level, and the points (unexposed points) with the normal potential level, are created, the contrast among which generates an electrostatic latent image in accordance with the image-formation information.

[Developing Apparatus]

The developing apparatus 4 is of a contact-type developing apparatus which uses two-component developer (two-component, magnetic brush-type developing apparatus). Referring to FIG. 2, the developing apparatus 4 comprises a development sleeve 4*a* functioning as a developer bearing member, and a magnetic roller 4*b* disposed within the hollow of the development sleeve 4*a*. The development sleeve 4*a* holds a layer of developer, which is a mixture of carrier and toner, on its peripheral surface. This development sleeve 4*a* is the actual developing means. The developing apparatus 4 also comprises a regulating blade 4*c*, which is disposed in the adjacencies of the peripheral surface of the development sleeve 4*a*, located at a predetermined distance from the development sleeve 4*a*. As the development sleeve 4*a* is rotated in the direction indicated by an arrow mark shown inside the development sleeve 4*a* in FIG. 2, a thin layer of developer is formed on the peripheral surface of the development sleeve.

Incidentally, the developing apparatus 4 in this embodiment is a two-component, magnetic brush-type developing apparatus. However, the developing apparatus 4 does not need to be of a two-component, magnetic brush-type development apparatus.

Referring to FIG. 4, the development sleeve 4*a* is provided with a pair of ring-shaped spacers 4*k*, which are rotatably fitted around the journal portions 4*a*1, that is, the lengthwise end portions of the development sleeve 4*a*, one for one, which are smaller in diameter than the developer carrying portion of the development sleeve 4*a*. With the provision of the spacers 4*k*, a predetermined gap is maintained between the development sleeve 4*a* and photoconductive drum 2 so that during a development operation, only the developer layer formed on the peripheral surface of the development sleeve 4*a* touches the photoconductive drum 2. Referring to FIG. 2, the development sleeve 4*a* is rotationally driven in the counterclockwise direction indicated by an arrow mark shown inside the development sleeve 4*a* in FIG. 2 at a predetermined peripheral velocity so that, in the development portion c, the peripheral surface of the development sleeve 4*a* moves in a direction counter to the moving direction of the peripheral surface of the photoconductive drum 2.

The toner in this embodiment is such toner that is negative in inherent polarity and is 6 $\mu$m in average particle diameter. The magnetic carrier in this embodiment is 205 emu/cm$^3$ in saturation magnetization, and is 35 $\mu$m in average particle diameter. The ratio in weight between the toner and carrier in the developer is 6:94. However, the developer choice does not need to be limited to a mixture of toner and magnetic carrier. For example, magnetic toner may be used.

Referring to FIG. 2, a developer storage portion 4*h* is provided, in which the developer is circulated. The developer storage portion 4*h* has two chambers divided by a partitioning wall 4*d* which extends in the lengthwise direction. The developer storage portion 4*h* has stirring screws 4*e*A and 4*eb*, which are disposed on both sides of the partitioning wall 4*d*, one for one.

Referring to FIG. 4, as the toner is supplied to the developer storage portion 4*h* from the developer supply container (developer supplying apparatus), the toner falls onto the back end portion (right end portion in FIG. 4) of the stirring screw 4*e*B, and is conveyed frontward (toward the left end portion of the apparatus in FIG. 4), in terms of the lengthwise direction of the apparatus, while being stirred. Then, it is moved through the gap between the front wall of the developer storage portion 4*h* and the partitioning wall 4*d*, and then, is conveyed backward (rightward in FIG. 4) through the developer storage portion 4*h*, in terms of the lengthwise direction of the developer storage portion 4*h*, by the stirring screw 4*e*A. Then, it is moved through the gap between the back wall of the developer storage portion 4*h* and the partitioning wall 4*d*. In other words, the developer is repeatedly circulated by the stirring screws 4*e*B and 4*e*A in the developer storage portion 4*h*.

At this time, referring to FIG. 2, the development process for developing an electrostatic latent image formed on the photoconductive drum 2 into a visible image with the use of the developing apparatus 4 which employs a two-component, magnetic-brush developing method, and the developer circulating system, will be described.

As the development sleeve 4*a* is rotated, the developer in the developer storage portion 4*h* is picked up and held to the peripheral surface of the development sleeve 4*a*, by the pickup pole of the magnetic roller 4*b*, and is conveyed further.

While being conveyed after being held to the peripheral surface of the development sleeve 4*a*, the body of developer is regulated in thickness by the development blade 4*c* disposed perpendicular to the peripheral surface of the development sleeve 4*a*. As a result, a thin layer of developer is formed on the peripheral surface of the development sleeve 4*a*.

As the thin layer of developer reaches the development portion c, which corresponds in position to the development pole of the magnetic roller 4*b*, the developer layer is made to crest by the magnetic force. Thus, the electrostatic latent image on the peripheral surface of the photoconductive drum 2 is developed into a visible image, by the toner in the crest of the developer layer. Incidentally, in this embodiment, an electrostatic latent image is reverse developed.

After being conveyed and passed through the development portion c, the thin layer of developer on the peripheral surface of the development sleeve 4*a* is made to enter the developer storage portion 4*h*, by the subsequent continual rotation of the development sleeve 4*a*. In the developer storage portion 4*h*, the developer layer is made to separate from the peripheral surface of the development sleeve 4*a*, by the repulsive magnetic field of the conveyance pole, and fall into the developer storage portion 4*h*. In other words, it is returned to the developer storage portion 4*h*.

To the development sleeve 4*a*, a combination of a DC voltage and an AC voltage is applied from an unshown electrical power source. In this embodiment, the combination of a DC voltage of −500 V and an AC voltage which is 2,000 Hz in frequency, and 1,500 V in peak-to-peak voltage, is applied to develop only the exposed points of the peripheral surface of the photoconductive drum 2.

Generally, in a two-component developing method, the application of AC voltage increases development efficiency, making it possible to form an image of higher quality. On the other hand, the application of AC voltage is likely to result in the formation of a foggy image. Therefore, it is a common practice to create a certain amount of difference in potential level between the potential level of the DC voltage applied to the development sleeve 4*a* and the potential level of the peripheral surface of the photoconductive drum 2 in order to prevent the formation of a foggy image. More specifically, a bias voltage (AC voltage), the potential level of which falls between the potential level of an exposed point of the peripheral surface of the photoconductive drum 2, and the potential level of an unexposed point of the peripheral surface of the photoconductive drum 2, is applied.

As the toner is consumed by the development of an electrostatic latent image, the toner content of the developer decreases. In this embodiment, a sensor 4*g* for detecting the toner content is disposed in the adjacencies of the peripheral surface of a developer stirring screw 4*e*B, as shown in FIG. 2. As it is detected by the sensor 4*g* that the toner content of the developer has fallen below a predetermined level, a command for supplying the developer storage portion 4*h* of the developing apparatus 4 with the toner from a toner supply container 5 is issued to initiate a toner-supplying operation, which maintains the toner content of the developer in the developing apparatus at a predetermined level.

[Toner Supply Container]

The toner supply containers 5Y, 5M, 5C, and 5K are disposed in parallel above the process cartridges 1Y, 1M, 1C, and 1K, respectively, and are mounted into the image forming apparatus 100 from the front side of the apparatus 100.

Referring to FIG. 2, the toner supply container 5 has a frame 5*g* functioning as the toner storage portion (developer storage portion), in which toner, or a mixture of toner and magnetic carrier, is stored. Within the toner supply container 5, a stirring plate 5*b* (also called a developer sending member) solidly fixed to a stirring shaft 5*c*, and a screw 5*a* (conveying member), are disposed. The bottom wall of the toner supply container 5 is provided with a toner outlet 5*f* having a developer releasing hole through which the toner is discharged into a process cartridge.

Figure 5:
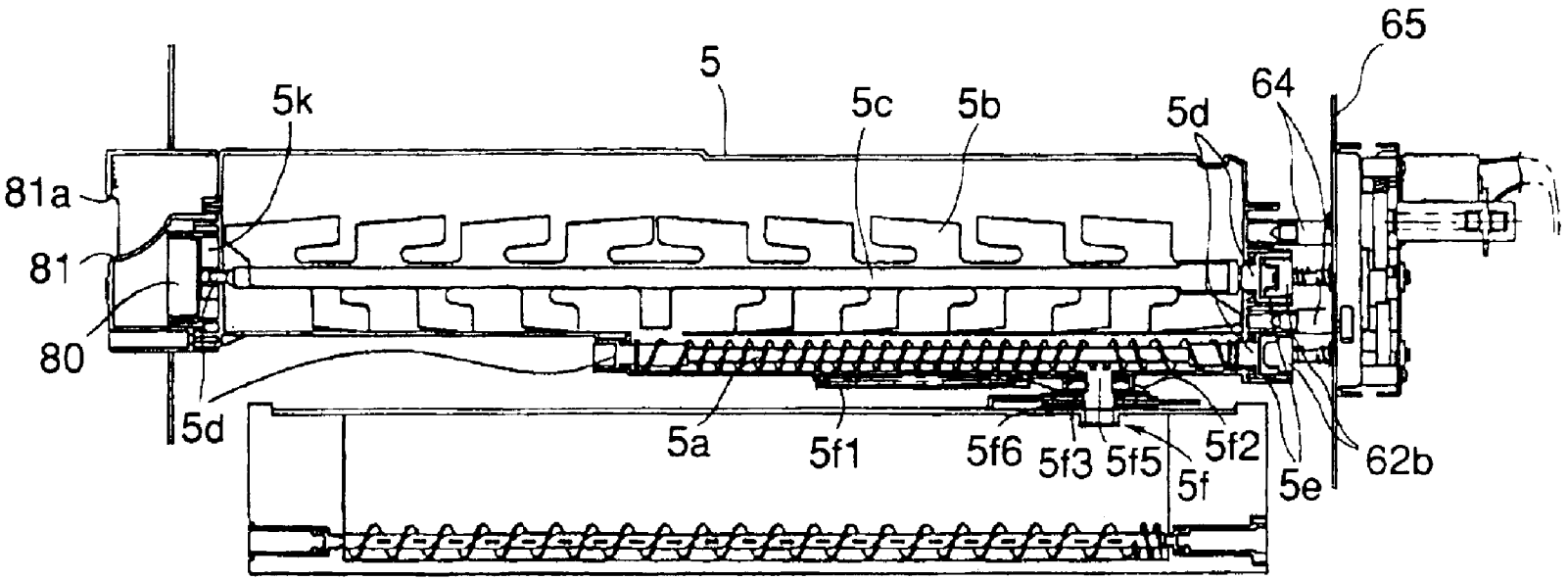
FIG. 5 is a vertical, lengthwise sectional view of the toner supply container and process cartridge, in the preferred embodiment of the present invention.

Referring to FIG. 5, the screw 5*a* and the stirring shaft 5*c* are rotatably supported by bearings 5*d*, at their lengthwise ends. The screw 5*a* is provided with a driving force receiving coupling (female coupling) 5*e*, which is attached to the back end (right end in FIG. 5) of the screw 5*a*, and the stirring shaft 5*c* is also provided with a driving coupling (female coupling) 5*e*, which is attached to the back end (right end in FIG. 5). The driving force receiving couplings (female couplings) 5*e* receive the driving force transmitted through the driving force transmitting couplings (male couplings) 62*b*, one for one, of the image forming apparatus 100, being thereby rotationally driven.

The screw 5*a* comprises two pieces of spiral ribs located on one side of the toner outlet 5*f* and the other, and twisted in the opposite direction. The screw 5*a* is rotated in a predetermined direction by the rotation of the driving force transmitting coupling 62*b*.

As a result, the toner is conveyed toward the toner outlet 5*f*, and free falls through the first toner releasing hole of the toner outlet 5*f* into the process cartridge 1; in other words, the process cartridge 1 is supplied with the toner.

The peripheral edge, that is, the outermost edge of each section of the stirring plate 5*b*, in terms of the rotational radius of the developer sending member 5*b*, is angled relative to the stirring shaft 5*c*. Thus, as each section of the stirring plate 5*b* rubs against the internal surface of the toner supply container 5, its peripheral edge portion is angled at certain degrees relative to its base portion. More specifically, the peripheral edge portion of each section of the stirring plate 5*b* is spirally twisted. Thus, as the stirring shaft 5*c* is rotated, the toner in the toner supply container 5 comes into contact with the spirally twisted edge portions of the stirring plate 5*c*, being thereby conveyed in the lengthwise direction of the stirring shaft 5*c*.

Not only can the toner supply container in this embodiment supply toner to a process cartridge, or a development cartridge, which employs a two-component developing method, but also the toner supply container can supply toner to a process cartridge or, a development cartridge, which employs a single-component developing method. Further, the powder to be stored in the toner supply container does not need to be limited to toner. For example, it may be the so-called developer, that is, a mixture of toner and magnetic carrier.

Figure 6:
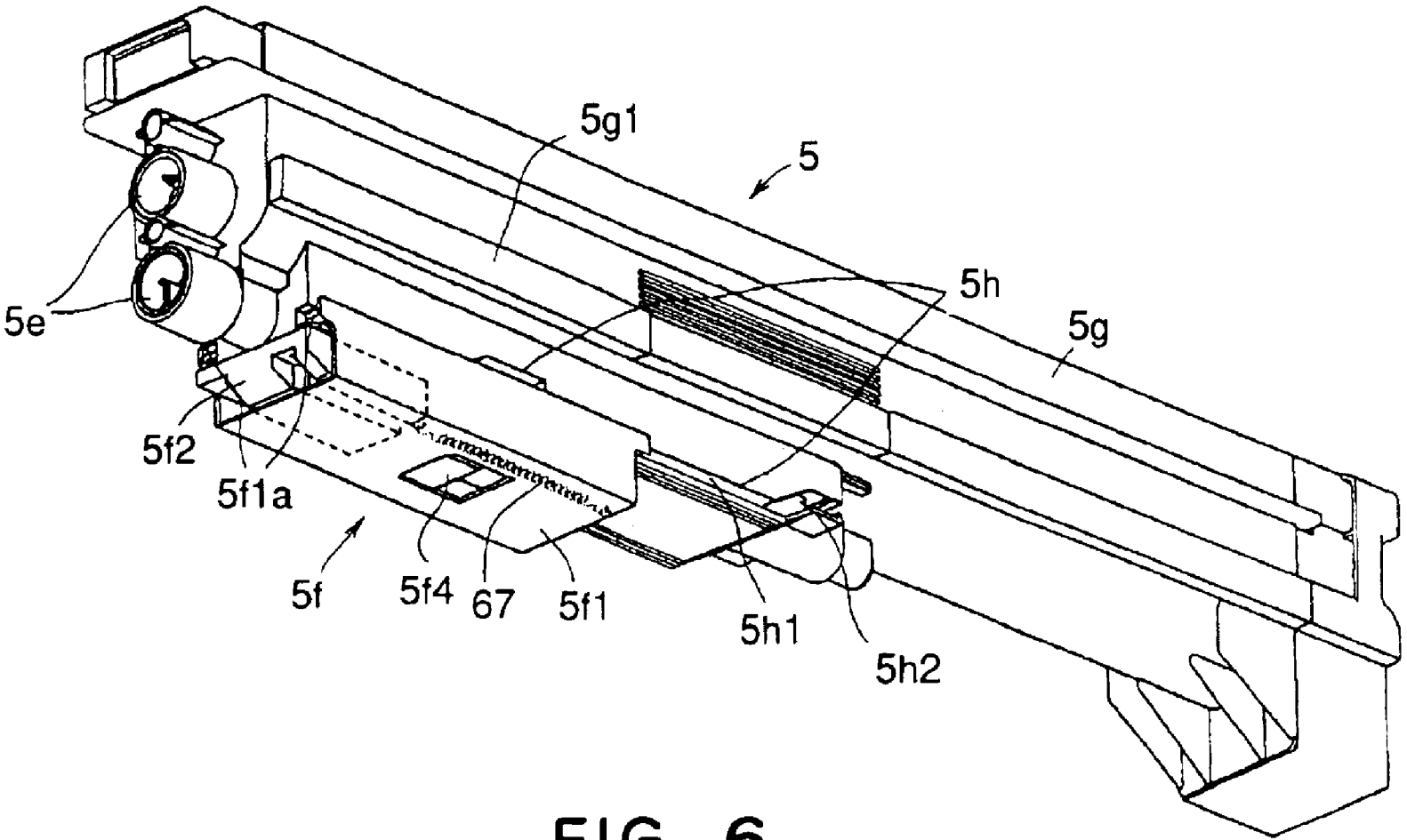
FIG. 6 is a perspective view of the toner supply container in the preferred embodiment of the present invention, the toner outlet cover of which is closed.

Referring to FIG. 6, which is a perspective view of the toner supply container 5 as seen from below the back end thereof, the toner supply container 5 is provided with a pair of guiding portions 5*g*1, which are on the lengthwise lateral walls, one for one, of the frame 5*g* functioning as the toner storage portion of the toner supply container 5, and which function as guides when the toner supply container 5 is inserted into the image forming apparatus 100.

The guiding portion 5*g*1 is rectangular in cross section, and extends straight in the lengthwise direction, on the corresponding lengthwise lateral wall of the toner supply container 5. With respect to the vertical direction of the toner supply container, the bottom surface of the guiding portion 5*g*1 is flat. When the toner supply container 5 is mounted into the image forming apparatus 100, the toner supply container 5 rides on the pair of guide rails 61 of the image forming apparatus 100, with the bottom surface of each guiding portion of the toner supply container 5 remaining in contact with the top surface of the corresponding guide rail 61 of the image forming apparatus 100, being thereby accurately positioning the toner supply container 5 relative to the image forming apparatus 100 in terms of the vertical direction (FIG. 2).

The toner supply container 5 is also provided with a toner outlet cover 5*f*1 for covering the opening of the toner outlet 5*f* located at the bottom of the toner supply container 5. The toner outlet cover 5*f*1 is movable in the lengthwise direction of the toner supply container 5.

Figure 8:
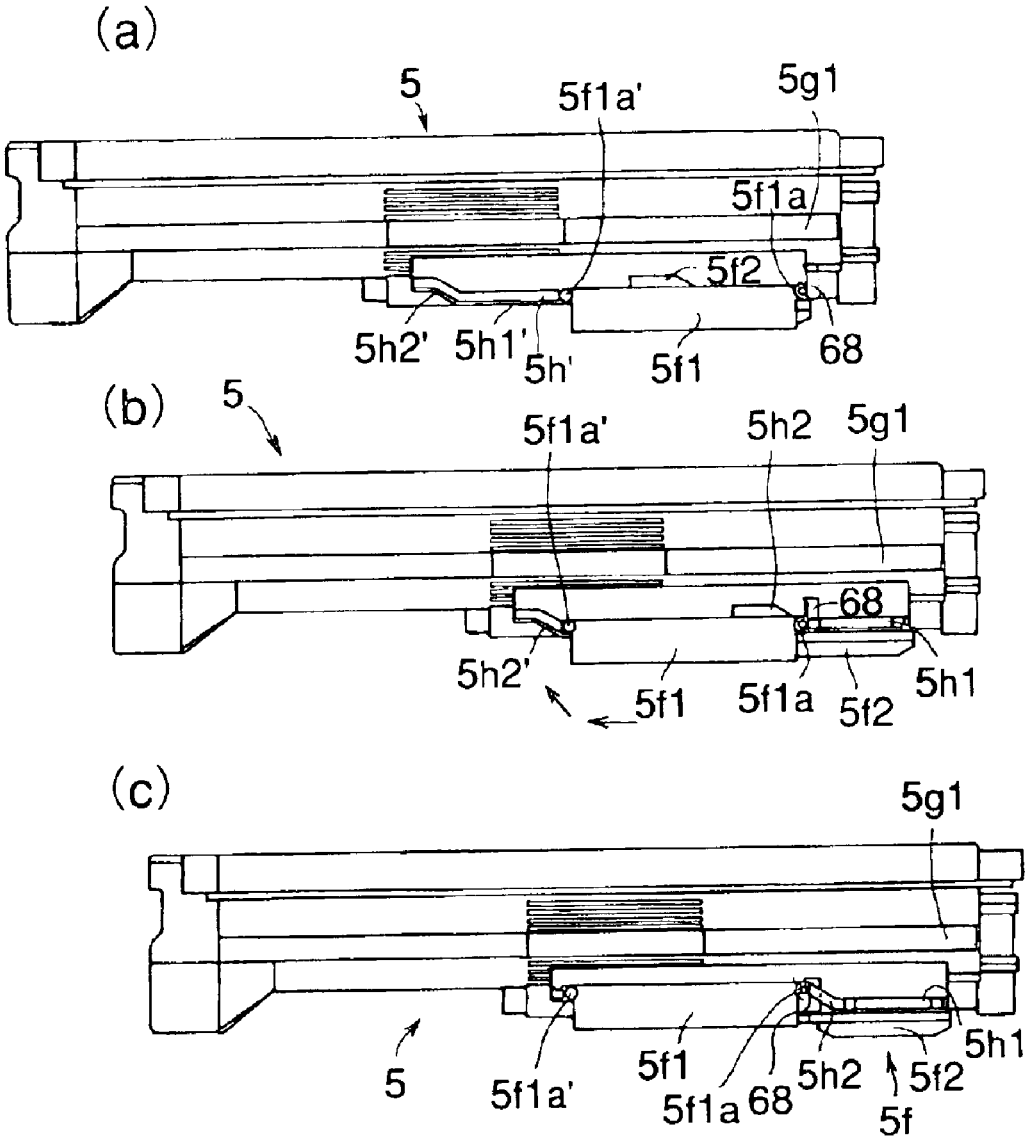
FIGS. 8(*a*)–8(*c*) are side views of the toner supply container in the preferred embodiment of the present invention, as seen from a direction perpendicular to the lengthwise direction of the toner supply container, for showing the movement of the toner outlet cover.

Referring to FIG. 8(*a*), before the insertion of the toner supply container 5 into the image forming apparatus 100, the toner outlet cover 5*f*1 is in the first position in which it covers the opening of the toner outlet 5*f*. In this position, the end 5*fla*' (also called a latching portion) of the toner outlet cover 5*f*1 is in contact with the right end of the rail 5*h*', preventing the toner outlet cover 5*f*1 from moving rightward.

Figure 7:
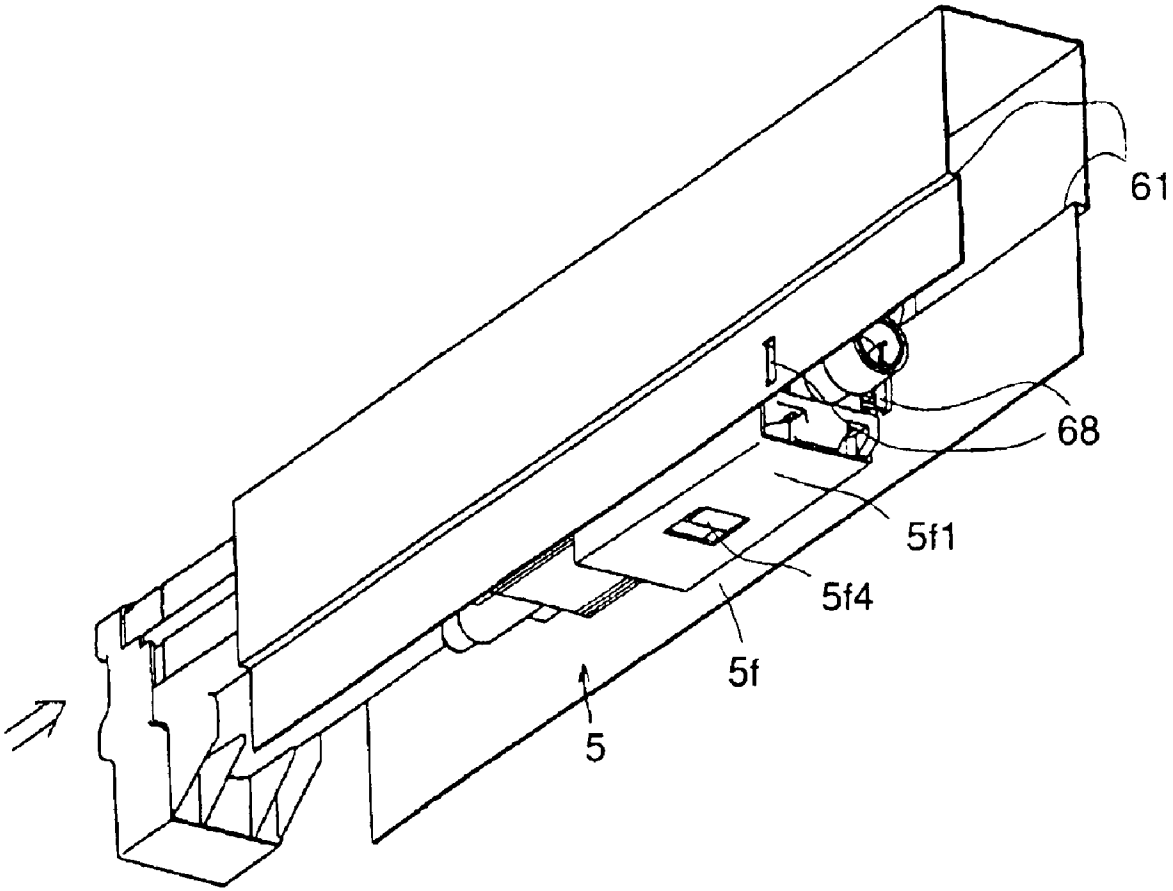
FIG. 7 is a perspective view of the toner supply container, which is being inserted into the apparatus main assembly.

As the toner supply container 5 is inserted into the image forming apparatus 100, the guide rails 61 of the image forming apparatus 100 support the toner supply container 5 in such a manner that the guiding portions 5*g* of the toner supply container 5 slide on the guide rails 61. During this insertion of the toner supply container 5, the leading end of the toner outlet cover 5*f*1, in terms of the toner-supply-container insertion direction, comes into contact with the projection 68 of the image forming apparatus 100, as shown in FIG. 7.

Referring to FIG. 8(*b*), as the toner supply container 5 is further inserted from the point of contact between the toner outlet cover 5*f*1 and projection 68, the toner outlet cover 5*f*1 is kept stationary by the projection 68 even though the other portions of the toner supply container 5 are further inserted. In other words, the toner outlet cover 5*f*1 is moved backward, in terms of the toner-supply-container insertion direction, relative to the toner supply container 5, while stretching the tension coil spring 67.

Next, referring to FIG. 8(*c*), also in terms of the position of the toner outlet cover 5*f*1 relative to the main assembly of the toner supply container 5, the toner outlet cover 5*f*1 slides along the rails 5*h* and 5*h*' until it slides into the second position in which it exposes a retaining member 5*f*2 by which the toner supply container 5 is connected to the process cartridge 1.

Next, this movement of the toner outlet cover 5*f*1 will be described in detail with reference to FIGS. 8(*a*)–8(*c*), which are side views of the toner supply container 5, as seen from the direction perpendicular to the lengthwise direction of the toner supply container 5, for sequentially showing the states of the toner supply container 5 through which the toner supply container 5 is inserted into the image forming apparatus 100. The insertion progresses from the state of toner supply container 5 shown in FIG. 8(*a*) to that in FIG. 8(*c*).

As described above, after coming into contact with the projection 68 of the image forming apparatus 100, the toner outlet cover 5*f*1 is moved along the first portions 5*h*1 and 5*h*1' of the rails 5*h* and 5*h*', respectively, relative to the toner supply container 5 in the virtually horizontal direction, that is, the direction virtually parallel to the toner supply container insertion direction. Then, it is moved along the second portions 5*h*2 and 5*h*2' of the rails 5*h* and 5*h*', respectively, being thereby moved in the upward direction, that is, the direction to move away from the process cartridge 1 having the developing means. As a result, the retaining member 5*f*2 is exposed.

In reality, during the insertion of the toner supply container 5 into the image forming apparatus 100, the toner outlet cover 5*f*1 does not move in the roughly horizontal direction. In fact, it simply retracts upward by being guided by the second portions 5*h*2 and 5*h*2' of the rails 5*h* and 5*h*'.

The toner outlet cover 5*f*1 is provided with two latching portions 5*fla* and 5*fla*', which are on each lateral wall of the toner outlet cover 5*f*1 , and the distance between which is the same as the distance between the two second portions 5*h*2 and 5*h*2' of the rails 5*h* and 5*h*', respectively, of each of the lateral walls of the toner supply container 5. Thus, the toner outlet cover 5*f*1 is retracted upward into the second position, its attitude remaining virtually the same as that when it is in the first position.

With the provision of the above-described structural arrangement, as the toner supply container 5 is inserted into the image forming apparatus 100, the toner outlet cover 5*f*1 is retracted in the direction (upward in FIGS. 8(*a*)–8(*c*)) to move away from the process cartridge 1 and the developing means. Therefore, the position, into which the toner outlet cover 5*f*1 is to be retracted as the toner supply container 5 is inserted into the image forming apparatus 100, has no effect on the positioning of the process cartridge 1, contributing to efficient space utilization.

Incidentally, in this embodiment, the process cartridge 1 and toner supply container 5 can be mounted into, or dismounted from, the image forming apparatus 100 at random. In other words, it is possible that the toner supply container 5 is in the image forming apparatus 100 before the mounting of the process cartridge 1.

In such a case, the problem occurs that the simple horizontal retraction of the toner outlet cover 5*f*1 from the first position allows the toner outlet cover 5*f*1 to come into contact with the toner inlet 1*b* of the process cartridge 1.

In order to prevent this problem by the structural modification on the process cartridge side, the process cartridge 1 must be structured so that the toner inlet 1*b* can be retracted. It is possible that such a structural arrangement makes the toner inlet 1*b* extremely complicated in structure. In comparison, the structural arrangement in this embodiment makes the toner outlet cover 5*f*1 of the toner supply container 5 retract in the direction to move away from the process cartridge 1, solving the above-described problem.

When the toner supply container 5 is removed from the image forming apparatus 100, it is moved back by the resiliency of an unshown tension coil spring into the first position, following in reverse the steps it went through when mounted.

Further, the toner supply container 5 is provided with a toner outlet shutter 5*f*3, which is disposed so that, when the toner supply container 5 is mounted into the image forming apparatus 100, the toner outlet cover 5*f*1 is moved into the second position (open position) before the toner outlet shutter 5*f*3 is moved from the closed position to the open position, and also that when the toner supply container 5 is removed from the image forming apparatus 100, the toner outlet cover 5*f*1 is moved from the open position to the closed position after the toner outlet shutter 5*f*3 is moved from the open position to the closed position.

Next, the structural arrangement for preventing the toner leak of the toner supply container 5 will be described. Referring to FIGS. 2 and 5, the toner supply container 5 is provided with the toner outlet 5*f*, which is attached to the bottom wall of the frame 5*g* of toner supply container 5, and through which the toner in the toner supply container 5 is discharged into the process cartridge 1. The bottom wall of the frame 5*g* of the toner supply container 5 is provided with a hole as the first hole 5*f*5 of the toner outlet 5*f*, which is in the center of the toner outlet 5*f*.

The toner outlet 5*f* has a first sealing member 5*f*6, which is bonded to the bottom wall of the frame 5*g* of the toner supply container 5 in a manner to surround the top edge of the first hole 5*f*5.

In this embodiment, the toner outlet 5*f* is located close to the lengthwise end of the toner supply container 5, on the side from which driving force is transmitted to the toner supply container 5, that is, on the back side (right side in FIG. 5) in terms of the toner-supply-container insertion direction.

Figure 14:
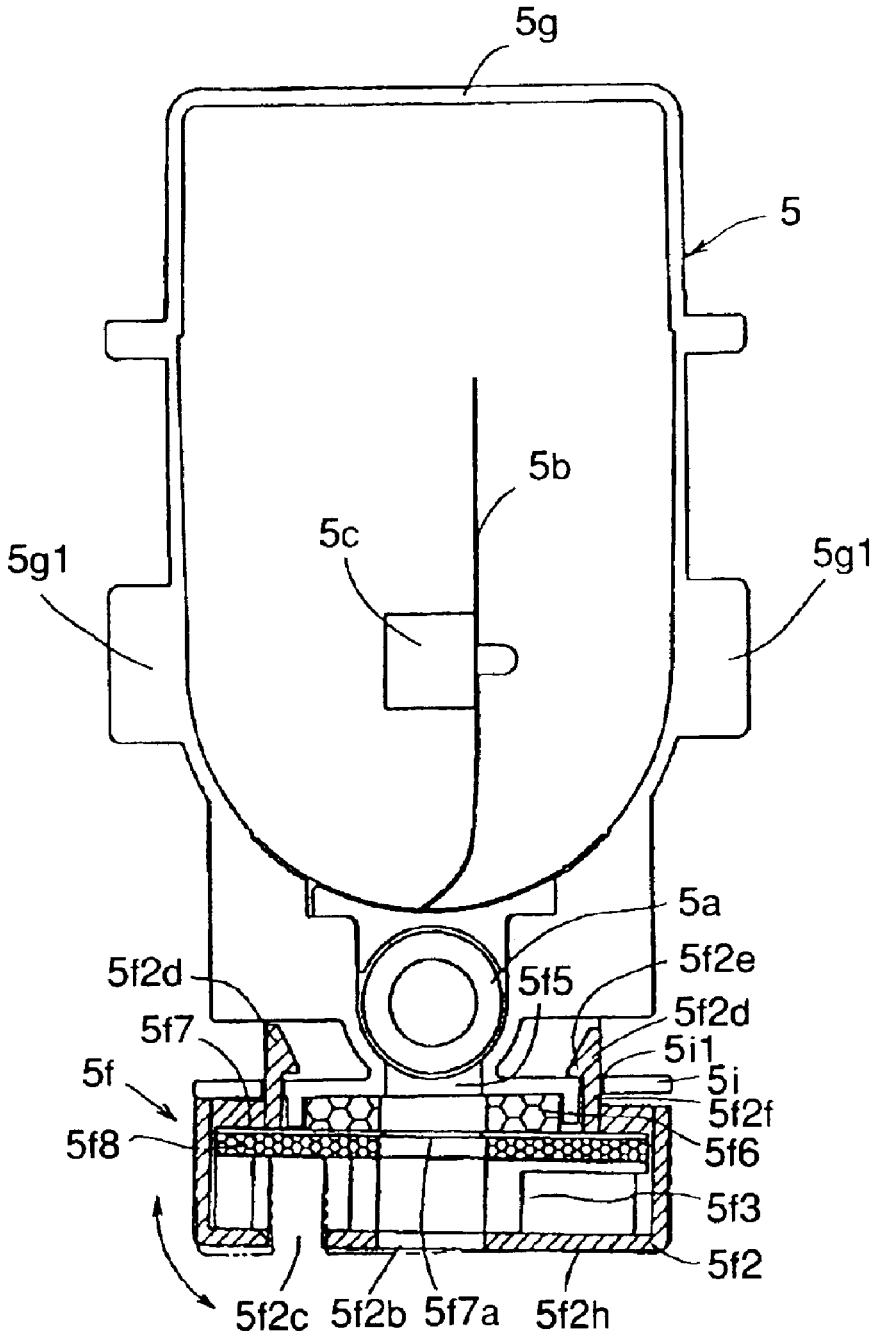
FIG. 14 is a vertical sectional view of the toner outlet portion, and its adjacencies, of the toner supply container in the preferred embodiment of the present invention.

At this time, referring to FIG. 14, the structures of the adjacencies of the first hole **5*f*5 will be described in detail. FIG. 14 is a vertical sectional view of the toner supply container 5, at a plane which is perpendicular to the lengthwise direction of the toner supply container 5 and includes the axis of the first hole 5*f*5 of the toner outlet 5*f*. The first hole 5*f*5, which is a through hole, is directly below the screw 5*a*, and the first sealing member 5*f*6 is attached to the bottom wall of the frame 5*g* of the toner supply container 5, surrounding the bottom edge of the first hole 5*f*5**.

The first sealing member **5*f*6 is provided to prevent toner from leaking from the interface between the toner supply container 5 and the toner outlet 5*f*. It is an elastic member with a certain amount of thickness and has a hole which is the same in cross section and size as the first hole 5*f*5. It is held to the toner supply container 5 by being pasted to the bottom edge portion of the first hole 5*f*5, by its top surface. The material for the first sealing member 5*f*6** in this embodiment is foamed urethane. However, it does not need to be limited to foamed urethane; it may be any elastic material.

There is a sealing plate **5*f*7 on the bottom side of the first sealing member 5*f*6. More specifically, the sealing plate 5*f*7 is pasted to the bottom surface of the first sealing member 5*f*6 by its top surface, being thereby held to the first sealing member 5*f*6. Thus, the sealing plate 5*f*7 is allowed to move vertically, and/or tilt, as the first sealing member 5*f*6 is compressed or decompressed. The sealing plate 5*f*7 is provided with a hole, that is, a third hole 5*f*7*a* of the toner outlet 5*f*, which is a through hole, and aligns with the first hole 5*f*5. Thus, the toner in the toner supply container 5 falls through the first hole 5*f*5, the hole of the first sealing member 5*f*6, and the third hole 5*f*7*a* of the sealing plate 5*f*7**, in this order.

The toner supply container 5 is also provided with the toner outlet shutter **5*f*3 for sealing or unsealing the first hole 5*f*5. The toner outlet shutter 5*f*3 is attached to the bottom wall of the frame 5*g* of the toner supply container 5. Further, the toner supply container 5 is provided with the retaining member 5*f*2, which has the function of preventing the toner outlet shutter 5*f*3 from falling down, and the function of connecting the toner outlet 5*f* of the toner supply container 5 with the toner inlet 1*b* of the process cartridge 1, and which is attached to the bottom of the toner supply container 5**.

Referring to FIG. 14, the toner outlet shutter **5*f*3 is below the sealing plate 5*f*7, with a second sealing member 5*f*8 sandwiched between the toner outlet shutter 5*f*3 and the sealing plate 5*f*7**.

The second sealing member **5*f*8 is for preventing the toner from leaking from the joint between the hole (the second hole 5*f*3*b* of the toner outlet) of the toner outlet shutter 5*f*3 and the hole (the third hole of the toner outlet) of the sealing plate 5*f*7. It is an elastic member having a hole, which aligns with the second hole 5*f*3*b*. It is solidly pasted to the toner outlet shutter 5*f*3, by its bottom surface. However, the top surface of the second sealing member 5*f*8 is not solidly attached to the bottom surface of the sealing plate 5*f*7, allowing the second sealing member 5*f*8 to slide on the bottom surface of the sealing plate 5*f*7. As for the material for the second sealing member 5*f*8, an elastic substance which is low in the friction against the sealing plate 5*f*7**, is preferable. For example, foamed urethane, a combination of a piece of foamed urethane and a low friction sheet pasted to the surface of foamed urethane, etc., can be used.

Figure 9:
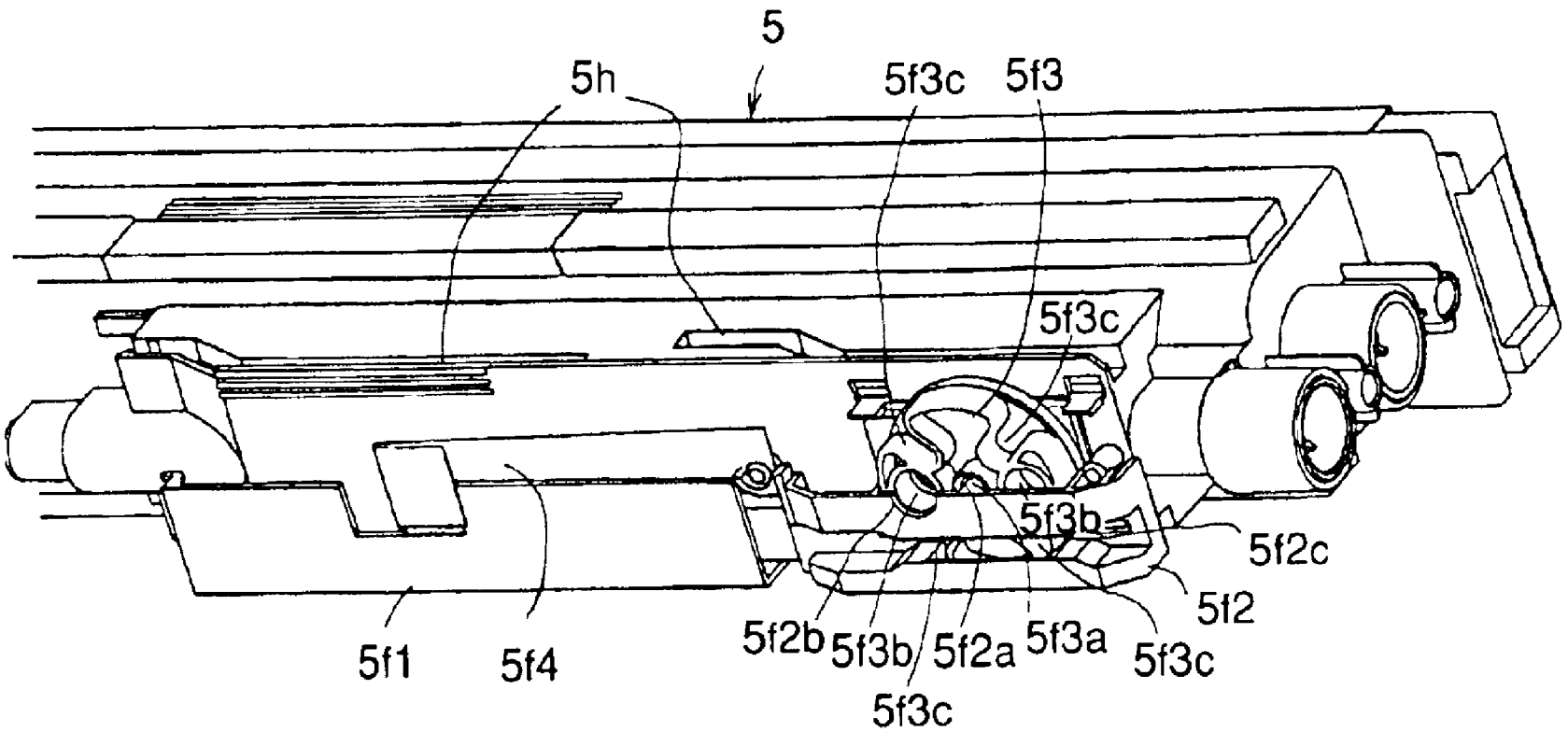
FIG. 9 is an enlarged perspective view of the toner outlet portion, and its adjacencies, of the toner supply container in the preferred embodiment of the present invention.

FIG. 9 is an enlarged perspective view of the bottom back end side of the toner supply container 5, the toner outlet cover **5*f*1 and the toner outlet shutter 5*f*3 which are in the open positions. In the drawing, the right half of the toner outlet cover 5*f*1, as seen from the trailing side of the toner supply container 5 in terms of the toner-supply-container insertion direction, has been removed in order to make it easier to understand the structure of the toner outlet and its adjacencies. As will be evident from FIG. 9, the toner outlet shutter 5*f*3 is provided with a center hole 5*f*3*a*, about the axial line of which the toner outlet shutter 5*f*3 is rotated. The toner outlet shutter 5*f*3 is also provided with two holes (the second holes 5*f*3*b* of the toner outlet) symmetrically positioned with respect to the axial line of the center hole 5*f*3*a*, and four slots, which are 45° apart from the adjacent second hole 5*f*3*b* in terms of the rotational phase of the toner outlet shutter 5*f*3, and in which the projections of the process cartridge 1 fit to rotate the toner outlet shutter 5*f*3**.

Figure 15:
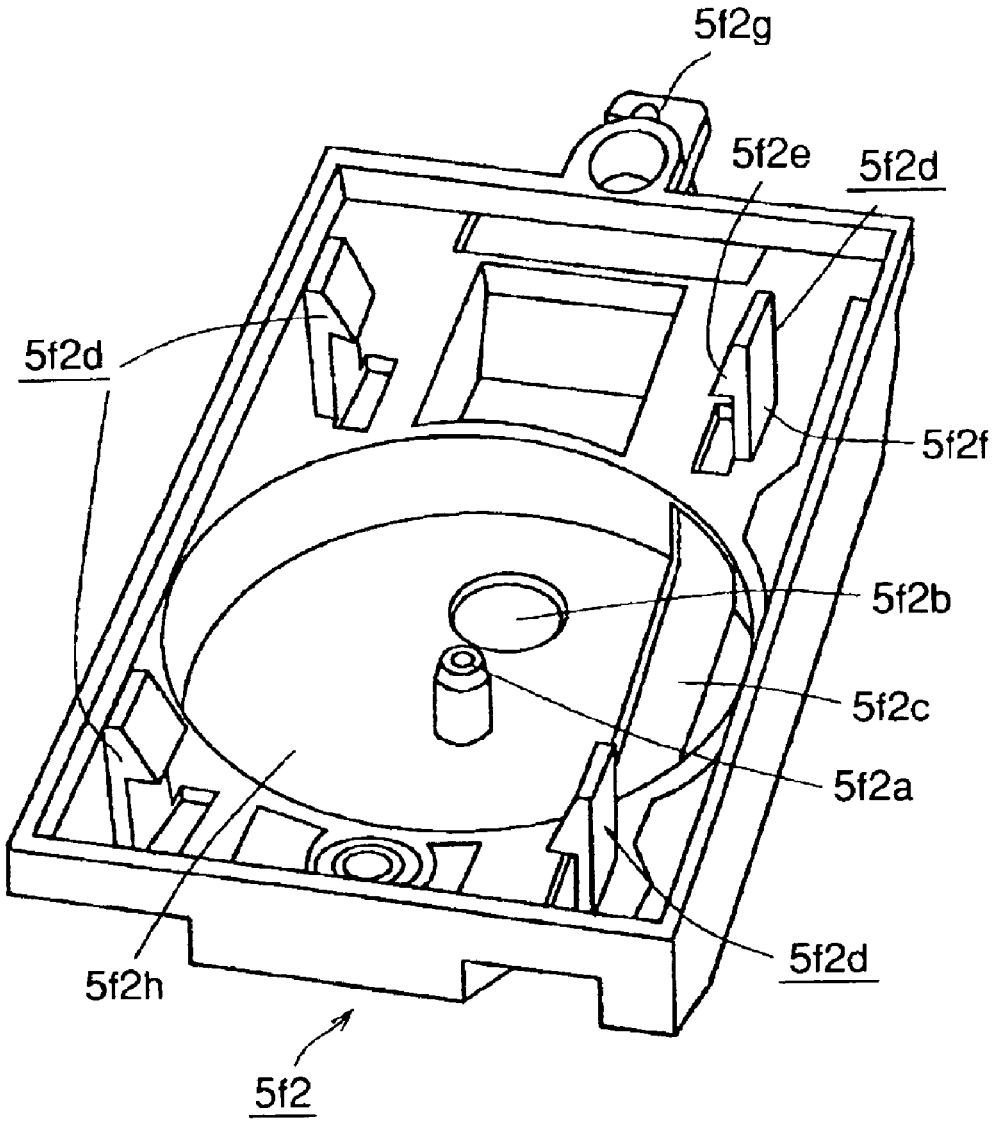
FIG. 15 is a perspective view of the shutter retaining member of the toner supply container in the preferred embodiment of the present invention.

Next, referring to FIG. 15, the retaining member **5*f*2 will be described. FIG. 15 is a perspective view of the retaining member 5*f*2 which has been removed from the toner supply container 5. The retaining member 5*f*2 is provided with a pin 5*f*2*a* with which the retaining member 5*f*2 rotationally supports the toner outlet shutter 5*f*3 so that the toner outlet shutter 5*f*3 rotates about the pin 5*f*2*a*, a through hole (the fourth hole of the toner outlet) 5*f*2*b* through which the toner is supplied, and an elongated hole 5*f*2*c* which extends practically straight in the lengthwise direction of the retaining member 5*f*2**.

The pin **5*f*2*a* is perpendicular to a bottom wall 5*f*2*h* of the retaining member 5*f*2. As the toner outlet shutter 5*f*3 is placed in the retaining member 5*f*2 so that the pin 5*f*2*a* fits into the center hole 5*f*3*a* of the toner outlet shutter 5*f*3, the toner outlet shutter 5*f*3 is rotatably supported by the retaining member 5*f*2**.

The retaining member **5*f*2 is provided with four hooks 5*f*2*d*, which project upward from the four corner portions of the retaining member 5*f*2. Referring to FIG. 14, as the retaining member 5*f*2 is pressed onto the bottom wall 5*i* of the frame 5*g* of the toner supply container 5, with the four hooks 5*f*2*d* of the retaining member 5*f*2 aligned with the four holes 5*i*1 of the bottom wall 5*i*, one for one, the four hooks 5*f*2*d* fit into the corresponding holes 5*i*1, and the claw 5*f*2*e* of each hook 5*f*2*d* latches onto the bottom wall 5*i*, holding the retaining member 5*f*2 to the toner supply container 5 as if the retaining member 5*f*2 is suspended from the bottom wall 5*i* of the toner supply container 5**.

The stem portion **5*f*2*f* of each hook 5*f*2*d* is made slightly longer than the exact length necessary to attach the retaining member 5*f*2 to the toner supply container 5. Therefore, the claw 5*f*2*e* of each hook 5*f*2*d* is kept downwardly pressed on the bottom wall 5*i* by the resiliency of the first sealing member 5*f*6, holding thereby the retaining member 5*f*2 as if the retaining member 5*f*2 is hanging from the bottom wall 5*i*. Further, each hook 5*f*2*d* fits in the corresponding hole 5*i*1, with the presence of a gap between the hook 5*f*2*d* and the wall of the hole 5*i*1, in terms of the horizontal direction, allowing the retaining member 5*f*2 to move left or right, or tilt, relative to the bottom wall 5*i***.

In other words, the retaining member **5*f*2 is held to the bottom wall 5*i* of the toner supply container 5, with the presence of a small amount of play, so that the retaining member 5*f*2 is allowed to move up and down, or tilt, relative to the frame 5*g* (FIG. 14). This tilting of the retaining member 5*f*2 is not limited to the left- and rightward directions, indicated by arrow marks; the retaining member 5*f*2*b*** is allowed to tilt also in the backward or frontward direction.

It should be noted here that the retaining member **5*f*2, the toner outlet shutter 5*f*3, and the sealing plate 5*f*7 are allowed to move together up and down, left or right, or tilt, relative to the frame 5***g*.

The toner outlet cover 5*f*1 is held to the toner supply container 5 by the rails 5*h* and 5*h*' of the toner supply container 5, covering the retaining member 5*f*2, so that the toner outlet shutter 5*f*3 is allowed to move toward the trailing side in terms of the toner-supply-container insertion direction, relative to the process cartridge 1, and then, retract upward.

Prior to the mounting of the toner supply container 5 into the image forming apparatus 100, the hole (the second hole 5*f*3*b*) of the toner outlet shutter 5*f*3 is in the first position which is deviated by 90° in rotational phase from the first hole 5*f*5 of toner outlet. Therefore, the first hole 5*f*5 is blocked by the toner outlet shutter 5*f*3.

The retaining member 5*f*2 is provided with another hook 5*f*2*g* for anchoring one end of the tension spring 67 to the retaining member 5*f*2, so that the toner outlet cover 5*f*1 is kept in the first position, in which the toner outlet cover 5*f*1 covers the retaining member 5*f*2, by the tension spring 67 (FIG. 6), while remaining under the pressure from the tension spring 67. Next, the sequence which occurs when the toner supply container 5 is inserted into, or extracted from, the image forming apparatus 100 will be described.

As described before with reference to FIGS. 8(*a*)–8(*c*), the image forming apparatus 100 is provided with the projection 68, which is projecting in the toner-supply-container insertion path. Thus, as the toner supply container 5 is inserted into the image forming apparatus 100, the leading end of the toner outlet cover 5*f*1 comes into contact with this projection 68. Then, as the toner supply container 5 is inserted deeper against the resiliency of the tension coil spring 67, the toner outlet cover 5*f*1 is kept stationary by the projection 68, while appearing as if it were moved backward relative to the main assembly of the toner supply container 5 along the rails 5*h* and 5*h*' of the toner supply container 5. Then, as the toner supply container 5 is inserted more deeply, the toner outlet cover 5*f*1 retracts upward by being guided the rails 5*h* and 5*h*'.

Figure 10:
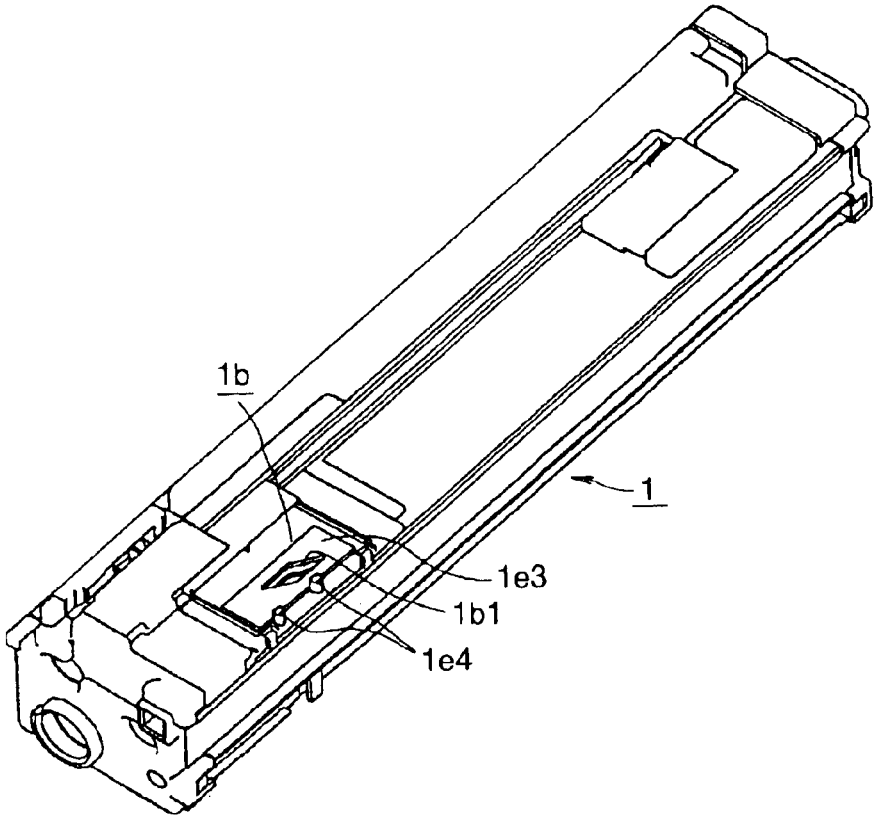
FIG. 10 is a perspective view of the process cartridge in the preferred embodiment of the present invention.

FIG. 10 is a perspective view of the process cartridge 1 in this embodiment as seen from the top front side. The toner inlet 1*b* through which the toner is supplied into the process cartridge 1 from the toner supply container 5 is provided with a toner entrance hole 1*b*1.

The toner entrance hole 1*b*1 is a through hole functioning as the passage through which the toner from the toner supply container 5 free falls. The toner inlet 1*b* is provided with a sealing member 1*e*3 for preventing the toner from leaking from the joint between the toner entrance hole 1*b*1 of the process cartridge 1 and the hole of the toner outlet 5*f* of the toner supply container 5. The sealing member 1*e*3 is formed of an elastic material, and has a hole which is the same in shape and size as the toner entrance hole 1*b*1.

The process cartridge 1 is also provided with a pair of guiding pins 1*e*4 for rotating the toner outlet shutter 5*f*3 of the toner supply container 5. The pair of guiding pins 1*e*4 are positioned next to the edge of the sealing member 1*e*3, being aligned in parallel to the lengthwise direction of the process cartridge 1.

The toner entrance hole 1*b*1 is a roughly parallelepipedic through hole, one of the two pairs of opposing edges of which are parallel to the lengthwise direction of the process cartridge 1. The aforementioned sealing member 1*e*3 is disposed in a manner to surround the toner entrance hole 1*b*1.

The sealing member 1*e*3 is for keeping sealed the interface (joint) between the retaining member 5*f*2 of the toner supply container 5 and the toner inlet 1*b* of the process cartridge 1. Not only is the sealing member 1*e*3 desired to have elasticity, but also it is desired to be highly effective for wiping toner away and low in friction. Thus, Teflon (registered commercial name) felt, Teflon pile, or the like felt or pile produced by electrostatic planting, foamed urethane, etc., for example, can be used as the material for the sealing member 1*e*3.

Figure 11:
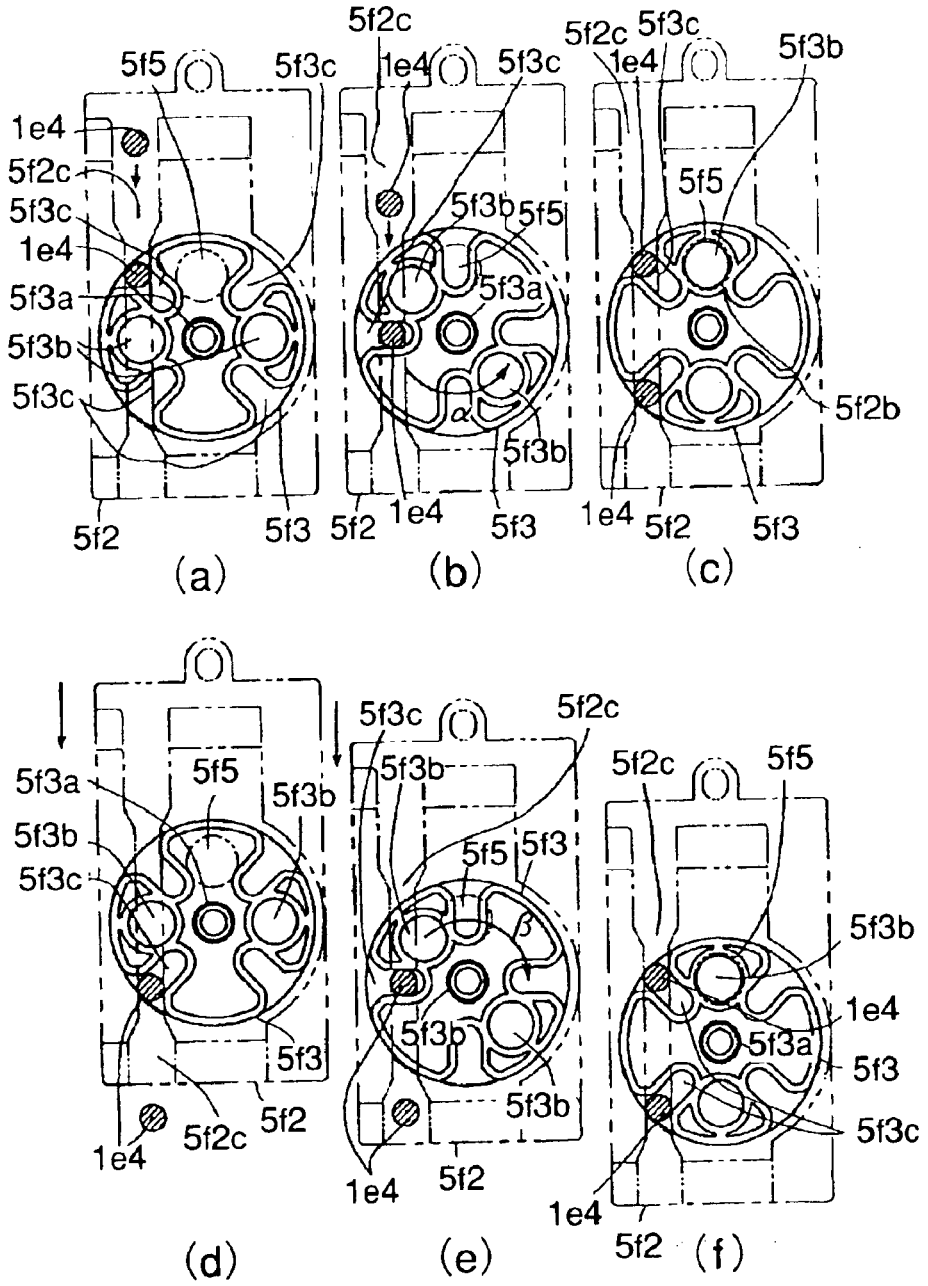
FIGS. 11(*a*)–11(*f*) are schematic drawings for showing the movement of the toner outlet shutter of the toner supply container in the preferred embodiment of the present invention.

FIGS. 11(*a*)–11(*f*) are drawings for showing the movement of the toner outlet shutter 5*f*3. FIGS. 11(*a*)–11(*c*) show the movements of the toner outlet shutter 5*f*3 that occur when the process cartridge 1 is inserted into the image forming apparatus 100 in which the toner supply container 5 is already present. FIGS. 11(*d*)–11 (*f*) show the movements of the toner outlet shutter 5*f*3 that occur when the toner supply container 5 is inserted into the image forming apparatus 100 in which the process cartridge 1 is already present.

Referring to FIGS. 11 (*d*)–11(*f*), when the toner supply container 5 is inserted into the image forming apparatus 100 in which the process cartridge 1 is already present, the guiding pins 1*e*4 do not move.

As the toner supply container 5 is inserted in the direction indicated by an arrow mark, the guiding pin 1*e*4 of the process cartridge 1, on the front side of the image forming apparatus 100, fits into the slot 5*f*3*c* of the toner outlet shutter 5*f*3 (FIG. 11 (*c*)). In this state, the first hole 5*f*5 remains closed by the toner outlet shutter 5*f*3 because the second hole 5*f*3*b* is apart from the first hole 5*f*5 by 90° in terms of the rotational direction.

As the toner supply container 5 is inserted deeper, the toner outlet shutter 5*f*3 begins to be rotated about the axial line of the center hole 5*f*3*a* of the toner outlet shutter 5*f*3 in the direction indicated by an arrow mark β (FIG. 11 (*e*)), and continues to be rotated until the toner supply container 5 is completely inserted. Consequently, the toner outlet shutter 5*f*3 is rotated into the position shown in FIG. 11(*f*), in which the first hole 5*f*5, that is, the hole of the bottom wall 5*i* of the frame 5*g* of the toner supply container 5 aligns with the second hole 5*f*3*b*, that is, the hole of the toner outlet shutter 5*f*3, allowing the toner to be discharged.

Next, referring to FIGS. 11 (*a*)–11(*c*), when the process cartridge 1 is inserted into the image forming apparatus 100 in which the toner supply container 5 is already present, the toner outlet shutter 5*f*3 is rotated without being changed in its position relative to the image forming apparatus 100.

As the process cartridge 1 is inserted in the direction indicated by an arrow mark, the guiding pin 1*e*4, on the back side of the image forming apparatus 100, fits into the slot 5*f*3*c* of the toner outlet shutter 5*f*3 (FIG. 11(*a*)). In this state, the first hole 5*f*5 remains closed by the toner outlet shutter 5*f*3 because the second hole 5*f*3*b* is apart from the first hole 5*f*5 by 90° in terms of rotational direction. As the process cartridge 1 is inserted deeper, the toner outlet shutter 5*f*3 begins to be rotated about the axial line of the center hole 5*f*3*a* of the toner outlet shutter 5*f*3 in the direction indicated by an arrow mark a (FIG. 11(*b*)), and continues to be rotated until the process cartridge 1 is completely inserted. Consequently, the toner outlet shutter 5*f*3 is rotated into the position shown in FIG. 11(*c*), in which the first hole 5*f*5, that is, the hole of the bottom wall 5*i* of the frame 5*g* of the toner supply container 5 aligns with the second hole 5*f*3*b*, that is, the hole of the toner outlet shutter 5*f*3, allowing the toner to be discharged.

Incidentally, when the toner outlet shutter 5*f*3 is in the state shown in FIGS. 11(*c*) and 11(*f*), the first hole 5*f*5, that is, the hole of the bottom wall of the frame 5*g* of the toner supply container 5, is aligned with the toner entrance hole 1*b*1 of the process cartridge 1.

As described above, the retaining member 5f2 is attached to the bottom wall 5i of the frame 5g of the toner supply container 5 so that the retaining member 5f2 is allowed to slightly move up or down, or slightly tilt, relative to the bottom wall 5i. Therefore, as the toner supply container 5 or process cartridge 1 is inserted into the image forming apparatus 100, the retaining member 5f2 conforms to the shape of the sealing member 1e3 of the process cartridge 1 (FIG. 10), remaining thereby airtightly in contact with the sealing member 1e3.

Therefore, the toner does not scatter from the container when the toner supply container 5 or process cartridge 1 is inserted into the image forming apparatus 100.

If the toner outlet shutter 5f3 alone is structured to prevent the toner from leaking from the toner outlet 5f, it is impossible to completely prevent the toner leak; it is virtually impossible to completely prevent the toner adhering to the internal surface of the second hole 5f3b, that is, the hole of the toner outlet shutter 5f3, from leaking. On the other hand, if the toner outlet cover 5f1 alone is structured to prevent the toner leak, it is possible that the toner will leak, because there is a possibility that a user might accidentally move the toner outlet cover 5f1 into the open position.

In this embodiment, however, both the toner outlet shutter 5f3 and the toner outlet cover 5f1 are provided with the toner leak prevention structure, as described above. In other words, two toner leak prevention means are provided, assuring that the toner does not leak; the toner adhering to the internal surface of the second hole 5f3b is prevented by the toner outlet cover 5f1 from leaking out. Further, the slots 5f3c of the toner outlet shutter 5f3 for rotationally driving the toner outlet shutter 5f3 remain covered with the toner outlet cover 5f1, eliminating the possibility that the toner outlet 5f will be accidentally exposed.

Figure 12:
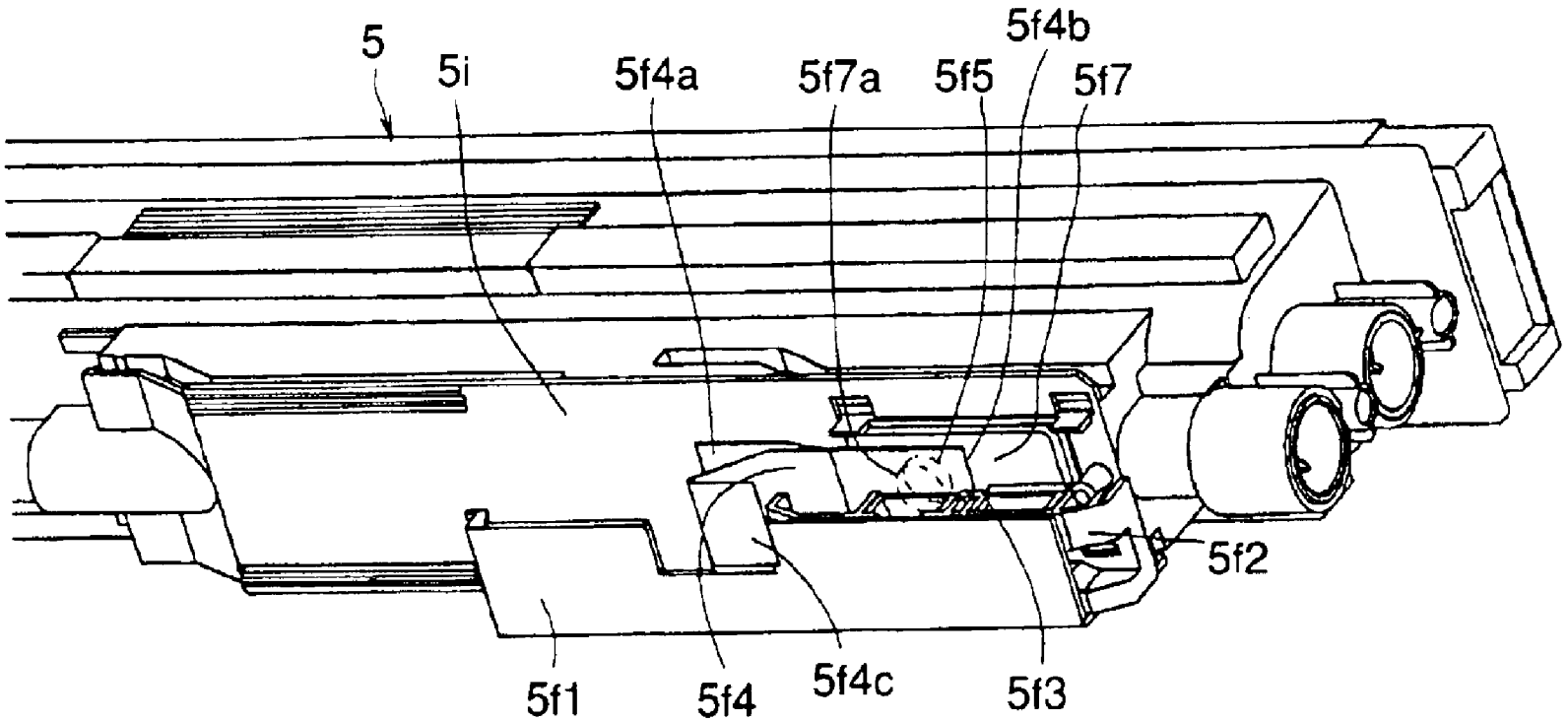
FIG. 12 is an enlarged perspective view of the toner outlet portion of the toner supply container in the preferred embodiment of the present invention, the toner outlet cover of which is closed.
Figure 13:
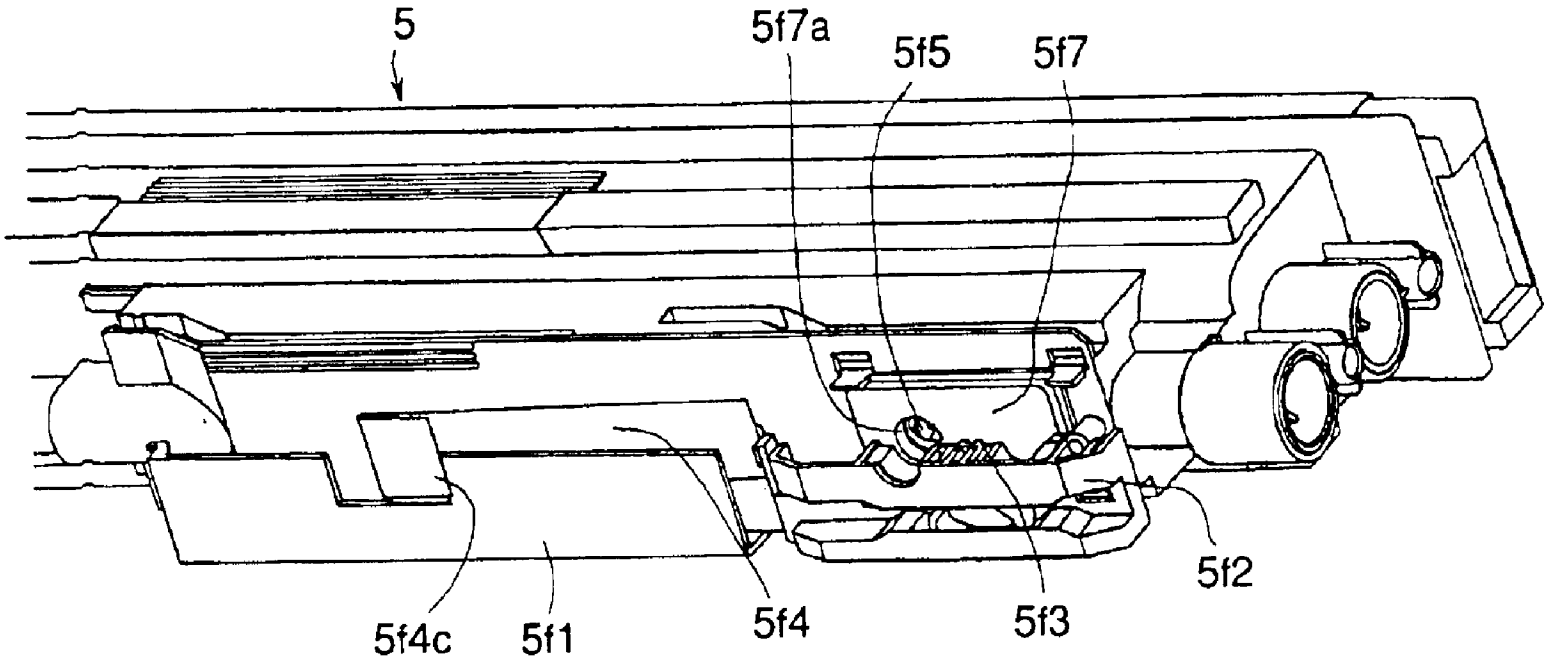
FIG. 13 is an enlarged perspective view of the toner outlet portion of the toner supply container in the preferred embodiment of the present invention, the toner outlet cover of which is open.

FIG. 12 is an enlarged perspective view of the back end portion of a brand-new toner supply container 5 as seen from the back bottom end of the container 5, in which, in this embodiment, the toner outlet shutter 5f3 and the toner outlet cover 5f1 are closed, and FIG. 13 is an enlarged perspective view of the back end portion of the brand-new toner supply container 5, in which, in this embodiment, the toner outlet shutter 5f3 and toner outlet cover 5f1 are open. In both drawings, the right halves of the toner outlet cover 5f1, the retaining member 5f2, and the toner outlet shutter 5f3, as seen from the trailing side of the toner supply container 5 in terms of the toner-supply-container insertion direction, have been removed in order to make it easier to understand their structures.

Referring to FIG. 12, when the toner supply container 5 is brand-new, the toner outlet cover 5f1 and the toner outlet shutter 5f3 are closed, and the first hole 5f5, that is, the hole of the bottom wall 5i of the frame 5g of the toner supply container 5, is surrounded by the sealing member 5f6 covered with the sealing plate 5f7 glued to the sealing member 5f6.

The hole of the sealing member 5f7, that is, the third hole 5f7a, is sealed with a flexible and peelable tape 5f4.

The tape 5f4 is positioned between the sealing plate 5f7 and the sealing member 5f8 (FIG. 14). It is attached to the toner supply container 5 in the following manner: the tape 5f4 is fixed to the bottom wall 5i of the frame 5g of the toner supply container 5, by one end 5f4a; extended toward the back end of the toner supply container 5, far enough to cover the third hole 5f7a; peelably glued or welded to the edge of the third hole 5f7a, sealing thereby the third hole 5f7a; folded back at the folding line 5f4b; doubled back over the portion of the tape 5f4 which is scaling the third hole 5f7a; and fixed to the toner outlet cover 5f1 by the other end 5f4c.

As described above, as the toner supply container 5 is inserted into the image forming apparatus 100, the toner outlet cover 5f1 is moved relative to the toner supply container 5 along the rails 5h and 5h', in a direction to expose the toner outlet 5f. Thus, the tape 5f4 is peeled from the bottom wall 5i, starting from the folding line 5f4b, exposing the third hole 5f7a. Incidentally, once the tape 5f4 is peeled, it does not return into the interface between the sealing plate 5f7 and the sealing member 5f8, even if the toner outlet cover 5f1 is returned to the closed position.

With the employment of the above-described structural arrangement, the third hole 5f7a remains sealed with the tape 5f4 from the completion of the production of the toner supply container 5 until the toner supply container 5 is inserted into the image forming apparatus 100 by a user or a service person after being obtained by the user through a distribution network. Therefore, the toner does not leak out even if the toner supply container 5 is subjected to shocks or excessive vibrations.

In this structural arrangement, the tape 5f4 is automatically peeled by the insertion alone of the toner supply container 5 into the image forming apparatus 100. Therefore, the employment of the tape 5f4 does not adversely affect the operability of the toner supply container 5. Further, the movement of the toner outlet cover 5f1 is regulated by the rails 5h and 5h'. Therefore, the problem that the tape 5f4 is pulled in an unexpected direction as the toner outlet cover 5f1 is moved relative to the toner supply container 5 does not occur. Therefore, the problem that the portions of the toner supply container 5 in the adjacencies of the tape 5f4 are damaged by the pulling of the tape 5f4 in the unexpected direction, and/or the problem that the force necessary to peel the tape 5f4 increases due to the pulling of the tape 5f4 in the unexpected direction, does not occur.

During the manufacture of the toner supply container 5, toner is poured into the toner supply container 5 through the toner entrance hole 5k of the toner supply container 5, as shown in FIG. 5. After the filling of the toner supply container 5 with toner, the toner entrance hole 5k is plugged with a toner entrance cap 80 to prevent the filled toner from leaking.

Also in this embodiment, the toner supply container 5 is provided with a handle 81, which is attached to the toner supply container 5 in a manner to cover the toner entrance cap 80. Therefore, a user is to handle the toner supply container 5 by the grip portion 81a of the handle 81.

[Transferring Means]

The intermediary transfer unit 54, functioning as a transferring means, in FIG. 1 is a unit for transferring (secondary transfer) all at once onto the recording medium 52 a plurality of toner images having been sequentially transferred in layers onto the intermediary transfer unit 54 from the photoconductive drum 2.

The intermediary transferring unit 54 is provided with an intermediary transfer belt 54a, which runs in the direction indicated by an arrow mark at virtually the same peripheral velocity as that of the photoconductive drum 2, which rotates in the clockwise direction indicated by another arrow mark. The intermediary transfer belt 54a is an endless belt with a circumferential length of approximately 970 mm, and is suspended around three rollers: a driver roller 54b, a belt backing transfer roller 54g, and a follower roller 54c.

Within the loop of the intermediary transfer belt 54a, transfer charge rollers 54fY, 54fM, 54fC, and 54fK are rotatably disposed, opposing the corresponding photoconductive drums 2 with the presence of the intermediary transfer belt 54a between the transfer charge rollers 54fY, 54*f*M, 54*f*C, and 54*f*K and the corresponding photoconductive drums 1. Each transfer charge roller is kept pressured toward the center of the corresponding photoconductive drum 2.

The transfer charge rollers 54*f*Y, 54*f*M, 54*f*C, and 54*f*K are supplied with power by an unshown high voltage power source, and charge the intermediary transfer belt 54*a* to a polarity opposite to that of the toner, from the inward side of the loop of the intermediary transfer belt 54*a*, in order to sequentially transfer (primary transfer) the toner images on the photoconductive drum 2 onto the outward surface of the intermediary transfer belt 54*a*.

During transfer, the secondary transfer roller 54*d* functioning as a transferring member is kept pressed on the intermediary transfer belt 54*a*, opposing the belt backing transfer roller 54*g* with the presence of the intermediary transfer belt 54*a* between the secondary transfer roller 54*d* and the belt backing transfer roller 54*g*. The secondary transfer roller 54*d* is movable in the vertical direction in FIG. 1, and is rotatable. Until a predetermined number of images are sequentially transferred in layers onto the intermediary transfer belt 54*a* to complete a multicolor image, the secondary transfer roller 54*d* is kept apart from the intermediary transfer belt 54*a* in order not to disturb the images on the intermediary transfer belt 54*a*.

The intermediary transfer belt 54*a* and the secondary transfer roller 54*d* are individually driven. As the recording medium 52 enters the secondary transfer portion, a predetermined bias is applied to the secondary transfer roller 54*d*. As a result, the toner images on the intermediary transfer belt 54*a* are transferred (secondary transfer) onto the recording medium 52.

During the transfer process, the recording medium 52 is conveyed leftward in FIG. 1 at a predetermined velocity, while remaining sandwiched between the secondary transfer roller 54*d* and the intermediary transfer belt 54*a*, to a fixing device 56 that carries out the next process.

The image forming apparatus 100 is provided with a cleaning unit 55, which can be placed in contact with, or moved away from, the surface of the intermediary transfer belt 54*a*, and which is at a predetermined location in the adjacencies of the downstream end of the intermediary transfer belt 54*a* in terms of the direction in which the recording medium is conveyed during the transfer process. The cleaning unit 55 removes the secondary transfer residual toner, that is, the toner remaining on the intermediary transfer belt 54*a* after the secondary transfer.

Referring again to FIG. 1, within the cleaning unit 55, a cleaning blade 55*a* for removing the secondary transfer residual toner is disposed. The cleaning unit 55 is attached to the main assembly of the image forming apparatus 100 so that it can be pivoted about an unshown pivotal axis. The cleaning blade 55*a* is kept pressed on the intermediary transfer belt 54*a*, being tilted so that the cleaning edge of the cleaning blade 55*a* is on the upstream side relative to the base portion of the cleaning blade 55*a* in terms of the moving direction of the intermediary transfer belt 54*a*. After being taken into the cleaning unit 55, the secondary transfer residual toner is conveyed by a screw 55*b* to a removed toner bin (unshown) and is stored therein.

As for the material for the intermediary transfer belt 54*a*, polyimide resin is usable. However, the material for the intermediary transfer belt 54*a* does not need to be limited to polyimide resin. For example, such plastics as polycarbonate resin, polyethylene-terephthalate resin, polyvinylidene fluoride resin, polyethylene naphthalate resin, polyether-ether-ketone resin, and polyether sulfonate resin, or fluorinated or siliconized rubber, can be used with preferable results.

[Fixing Portion]

As described above, a toner image formed on the photoconductive drum 2 by the developing means is transferred onto the recording medium 52 by way of intermediary transfer belt 54*a*. The fixing device 56 thermally fixes the unfixed toner images, that is, the images having just been transferred onto the recording medium 52.

Also referring to FIG. 1, the fixing device 56 is provided with a fixing roller 56*a* for applying heat to the recording medium 52, and a pressure roller 56*b* for pressing the recording medium 52 against the fixing roller 56*a*. Both rollers 56*a* and 56*b* are hollow. Each roller contains a heater (unshown) in a hollow portion thereof. They together convey the recording medium 52 as they are rotationally driven.

In other words, while the recording medium 52, which is bearing toner images, is conveyed by the fixing roller 56*a* and pressure roller 56*b*, heat and pressure are applied to the recording medium 52 and toner images by the rollers. As a result, the toner images are fixed to the recording medium 52.

After the fixation, the recording medium 52 is discharged out of the main assembly of the image forming apparatus 100 by two pairs of discharge rollers 53*h* and 53*j*, into a delivery tray 57 on top of the image forming apparatus 100, and is accumulated therein.

[Mounting of Process Cartridge and Toner Supply Container]

Figure 3:
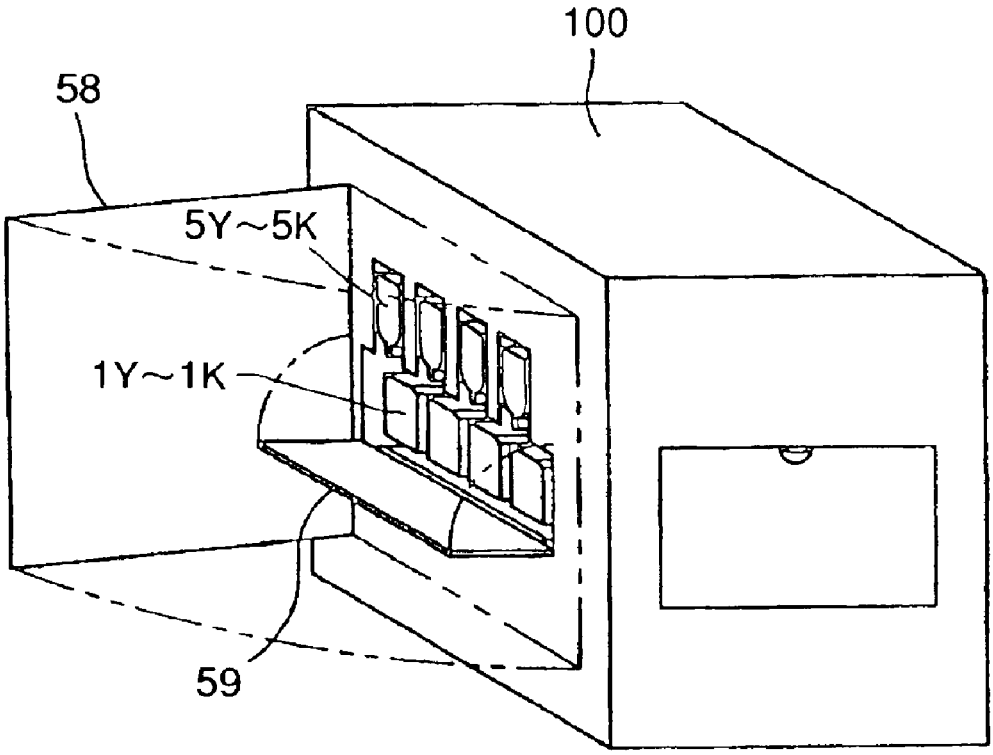
FIG. 3 is a perspective view of the image forming apparatus in the preferred embodiment of the present invention, the front door of which is open.

Next, referring to FIGS. 2–5, the procedure for mounting the process cartridge 1 and the toner supply container 5 into the image forming apparatus 100 will be described. Referring to FIG. 3, which is a schematic, external, perspective view of the image forming apparatus 100, the image forming apparatus 100 is provided with a door (front door) 58, which is located in the front panel of the image forming apparatus 100 and can be freely opened or closed. As an operator opens the door 58 frontward, the openings through which the process cartridges 1Y–1K, and toner supply containers 5Y–5K, are inserted, are exposed.

The openings through which the process cartridge 1 is inserted are provided with the drum shaft positioning plate 59, which is rotatably supported. Thus, when inserting or removing the process cartridge 1, this drum shaft positioning plate 59 must be opened and closed. Referring to FIG. 2, in the image forming apparatus 100, four pairs of guiding rails 60 for guiding the process cartridge 1 when mounting the process cartridge 1, and four pair of guiding rails 61 for guiding the toner supply container 5 when mounting the toner supply container 5, are provided.

The directions in which the process cartridge 1 and the toner supply container 5 are mounted into the image forming apparatus 100 are parallel to the axial line of the photoconductive drum 2, and so are the directions in which the guiding rails 60 and 61 extend. The process cartridge 1 and the toner supply container 5 are inserted into the image forming apparatus 100, from the front side of the image forming apparatus 100, and then, are slid deeper into the image forming apparatus 100 along the guiding rails 60 and 61.

Referring to FIG. 4, as the process cartridge 1 reaches the deepest end of the image forming apparatus 100, the drum positioning shaft 66 of the image forming apparatus 100 enters the center hole 2*f* of the drum flange 2*b*. As a result, the rotational axis of the back end of the photoconductive drum 2 is accurately positioned relative to the image forming apparatus 100.

At the same time, the driving force transmitting portion 2*g* of the drum flange 2*b* engages with the driving coupling (female coupling) 62*a* of the image forming apparatus 100, making it possible for the photoconductive drum 2 to be rotationally driven. The driving force transmitting portion 2*g* in this embodiment is in the form of a twisted triangular column. Thus, as the driving force is transmitted to the driving force transmitting portion 2*g* from the image forming apparatus 100, not only does the driving force transmitting portion 2*g* transmit the driving force to the photoconductive drum 2, but also generates such force that pulls the photoconductive drum 2 toward the back end of the image forming apparatus 100.

Also referring to FIG. 4, the rear wall 65 of the image forming apparatus 100 is provided with four cartridge supporting pins 63 for accurately positioning the process cartridges 1, one for one. Each cartridge supporting pin 63 enters the frame 1*a* of the inserted process cartridge 1, whereby the frame 1*a* of the process cartridge 1 is accurately fixed in its position relative to the image forming apparatus 100.

Referring again to FIG. 4, on the front side (left side in FIG. 4) of the image forming apparatus 100, the drum shaft positioning plate 59, which is rotationally opened or closed, is disposed, and with which the bearing case 2*c* of the process cartridge 1 is solidly engaged. Through the above-described process-cartridge-insertion sequence, the photoconductive drum 2 and process cartridge 1 are accurately positioned relative to the image forming apparatus 100.

In comparison, referring to FIG. 5, as the toner supply container 5 is inserted to the deepest end, it is solidly held by the supporting pin 64 projecting from the rear wall 65 of the image forming apparatus 100 as is the process cartridge 1 by the supporting pin 63. At the same time, the driving force receiving coupling (female) 5*e* engages with the driving force transmitting coupling (male) 62*b*, making it possible to rotationally drive the screw 5*a* and the stirring shaft 5*c*.

All that is necessary to extract the process cartridge 1 or the toner supply container 5 from the image forming apparatus 100 is to carry out the above-described procedures in reverse. In this embodiment, the process cartridge 1 and the toner supply container 5 can be mounted into, or removed from, the image forming apparatus 100 in random order.

In other words, it is possible to mount the toner supply container 5 into the image forming apparatus 100 after mounting the process cartridge 1 into the image forming apparatus 100, or to mount the process cartridge 1 into the image forming apparatus 100 after mounting the toner supply container 5 into the image forming apparatus 100.

Further, it is possible to extract the toner supply container 5 from the image forming apparatus 100 after extracting the process cartridge 1 from the image forming apparatus 100, or to extract the process cartridge 1 from the image forming apparatus 100 after extracting the toner supply container 5 from the image forming apparatus 100.

[Method for Refilling Toner Supply Container with Toner]

Figure 16:
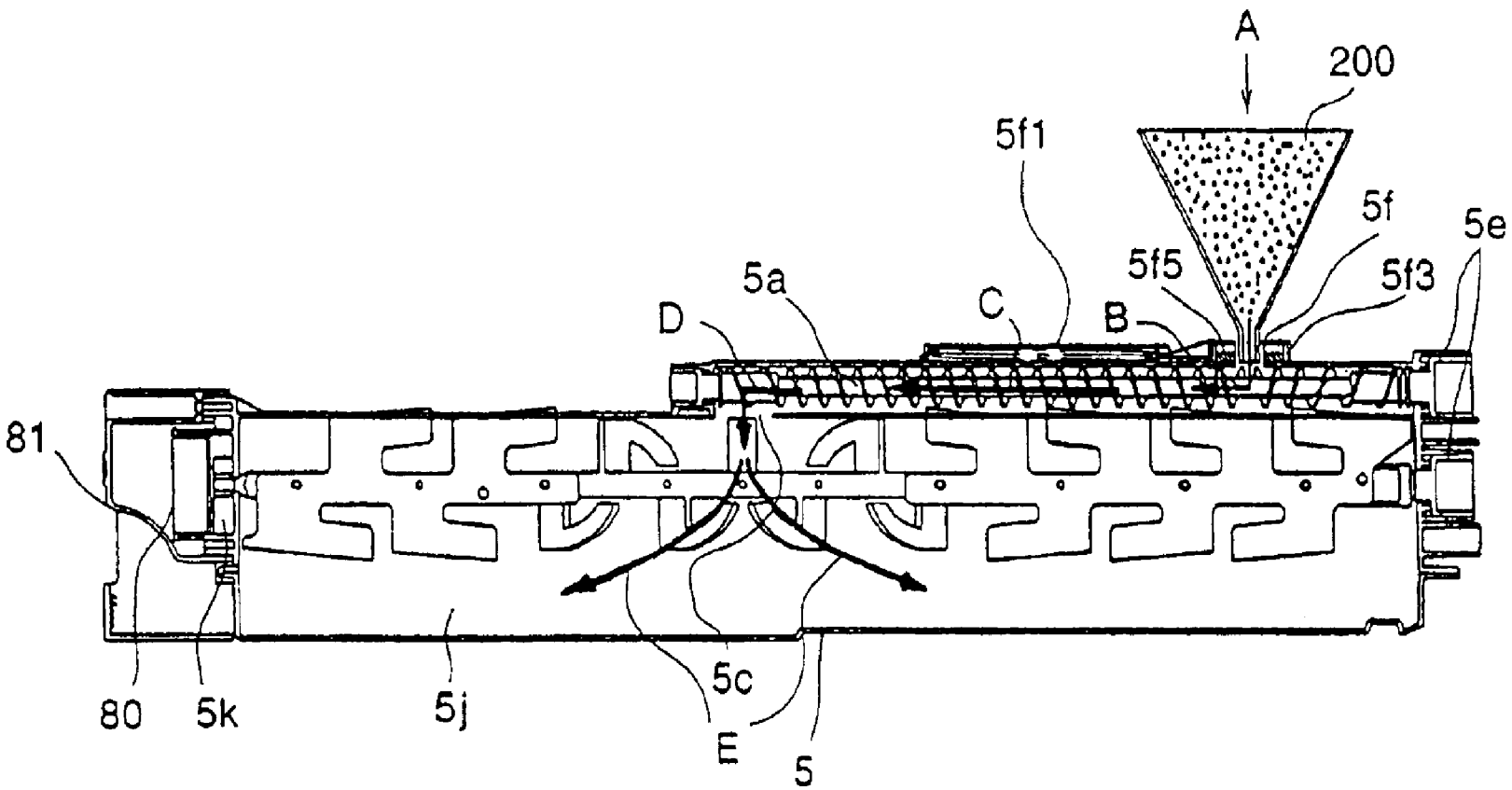
FIG. 16 is a vertical sectional view, parallel to the lengthwise direction of the toner supply container, of the toner supply container in the preferred embodiment of the present invention, for showing the method for filling the toner supply container with toner through the toner outlet.

FIG. 16 shows a method for refilling the used toner supply container 5 with toner, in other words, a method for remanufacturing the used toner supply container 5 by refilling it with toner.

First, the toner outlet cover 5*f*1 is to be slid. Then, the toner outlet shutter 5*f*3 of the toner supply container 5 is to be rotated to expose the opening of the toner outlet 5*f*, through which the toner is discharged (toner outlet exposing process).

Next, the toner supply container 5 is to be secured so that the toner outlet 5*f* of the toner supply container 5 faces upward. Then, toner is to be filled into the toner supply container 5 through the toner outlet 5*f* by inserting a toner refilling jig 200 as a member for guiding toner to the first hole 5*f*5 as indicated by an arrow mark A in FIG. 16 (filling process).

During this filling of toner, the screw 5*a*, functioning as a toner conveying member, in the toner supply container 5 is rotated in the direction opposite to the direction in which the screw 5*a* is rotated to convey the toner to the developing apparatus 4, so that the filled toner is sent deeper into the toner supply container 5, as indicated by arrow marks B, C, and D (driving process). In other words, the screw 5*a* is driven to convey the toner from the toner outlet 5*f* to the toner storage portion 5*j*. The toner is conveyed first in the direction indicated by the arrow mark C, parallel to the axial direction of the screw 5, and then, in the direction indicated by the arrow mark D.

Incidentally, it does not matter which process is started first, the filling process or driving process. In other words, the driving force may be transmitted to the screw 5 after the pouring of toner into the toner supply container 5 through the hole 5*f*5, or toner may be poured into the toner supply container 5 through the hole 5*f*5 after starting to transmit the driving force to the screw 5*a*. Further, the transmission of the driving force to the screw 5*a* may be started at the same time as the pouring of toner into the hole 5*f*5 is started.

The screw 5*a* is driven by a transmitting driving force to the driving force receiving coupling 5*e*. There are two methods for providing the screw 5*a* with a driving force: a method which employs a driving force generating apparatus 510 shown in FIG. 17, and a manual method which employs a rotational force transmitting member 520 shown in FIG. 18.

Figure 17:
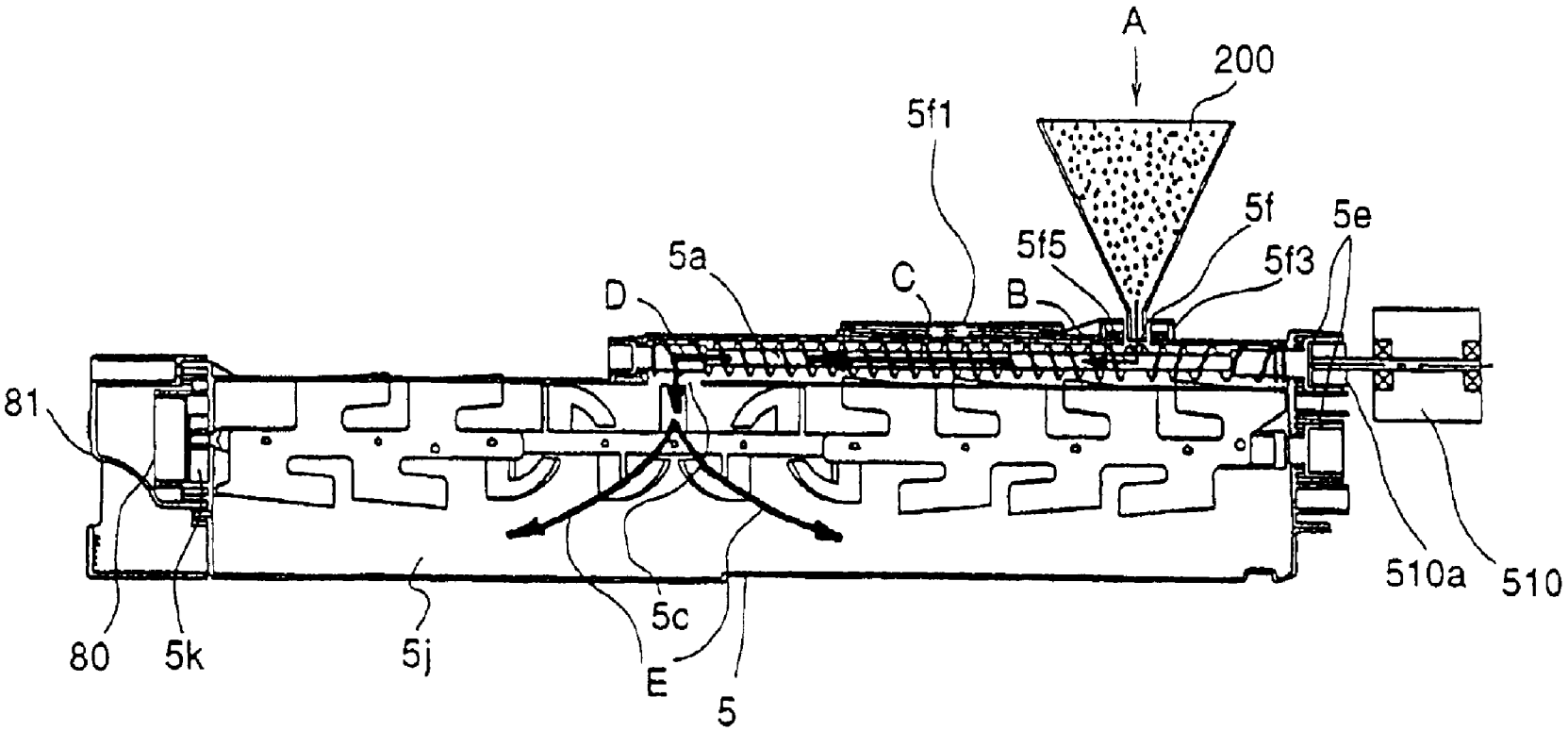
FIG. 17 is a vertical sectional view, parallel to the lengthwise direction of the toner supply container, of the toner supply container in the preferred embodiment of the present invention, for showing the method for filling the toner supply container with toner through the toner outlet, with the use of a driving force generating apparatus.

In the method which employs the driving force generating apparatus 510 to provide the screw 5 with a driving force, the coupling 510*a* of the driving force generating apparatus 510 is connected with the driving force receiving coupling 5*e*, as shown in FIG. 17, and a driving force is transmitted from the driving force generating apparatus 510 to the driving force receiving coupling 5*e* so that the screw 5*a* will convey toner in the direction indicated by the arrow mark C. In other words, the driving force receiving coupling 5*e* is rotated in the direction opposite to the direction in which it is rotated when toner is supplied to the process cartridge 1.

Figure 18:
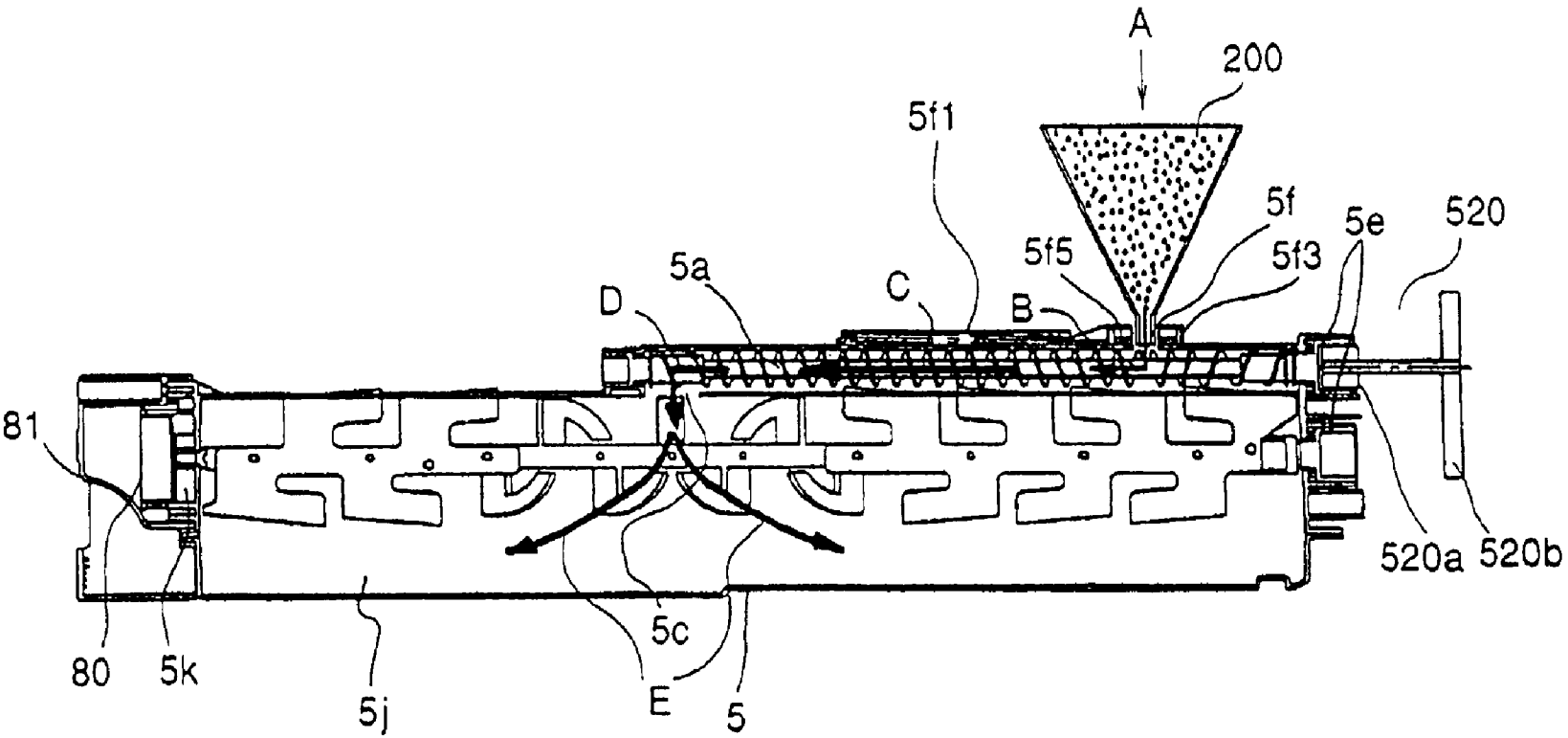
FIG. 18 is a vertical sectional view, parallel to the lengthwise direction of the toner supply container, of the toner supply container in the preferred embodiment of the present invention, for showing the method for filling the toner supply container with toner through the toner outlet, with the use of a rotational force transmitting member which is to be manually rotated.

In the manual method which employs the rotational force transmitting member 520, the coupling 520*a* of the rotational force transmitting member 520 is connected to the driving force receiving coupling 5*e* as shown in FIG. 18, and the rotational force transmitting member 520 is manually rotated by a knob 520*b* to transmit the driving force to the coupling 5*e* so that the screw 5*a* conveys toner in the direction indicated by the arrow mark C.

As described above, the toner supply container 5 can be refilled with toner simply by pouring toner through the toner outlet 5*f* in the direction opposite to the direction in which toner is discharged when the toner supply container 5 is in use. Therefore, the toner supply container 5 can be simply remanufactured.

Also as described above, the toner outlet 5*f* of the toner supply container 5 is provided with the movable toner outlet cover 5*f*1 for covering the toner outlet 5*f*. Therefore, the toner supply container 5 can be refilled with toner by opening this toner outlet cover 5*f*1, and the refilled toner can prevented from leaking, by closing the toner outlet cover 5*f*1 after the refilling (toner outlet closing process). Thus, the toner supply container 5 can be refilled a substantial number of times.

Incidentally, in a toner-supply-container refilling method in which the toner cap 80 is removed to refill the toner supply container 5 with toner through the toner filling hole 5*k*, there is a possibility that the toner cap 80 will be damaged when it is removed. Obviously, a damaged toner cap 80 is not reusable. In comparison, in this embodiment, the toner cap 80 is not removed when refilling the toner supply container 5 with toner. Therefore, it is assured that the toner cap 80 is reused; in other words, the entirety of the toner supply container 5 can be reused, without any damage to its components.

As described above, in this embodiment, the toner supply container 5 is structured so that it can be refilled with toner simply by pouring toner through the toner outlet in the direction in which toner flows when it is in use. Therefore, virtually the enturety of the supply container 5 can be reused. In addition, component removal is unnecessary, eliminating component damage, and therefore, assuring that all the components can be reused. In other words, the toner supply container 5 in accordance with the present invention can be reused in entirety for its remanufacure.

While the invention has been described with reference to the structures disclosed herein, it is not confined to the details set forth, and this application is intended to cover such modifications or changes as may come within the purposes of the improvements or the scope of the following claims.

What is claimed is:

1. A recycling method for a developer supply unit for supplying a developer to developing means for developing an electrostatic latent image formed on an electrophotographic photosensitive member, wherein the developer supply unit is detachably mountable to a main assembly of an electrophotographic image forming apparatus and includes a developer accommodating portion accommodating the developer, a developer supply port for supplying the developer to the developing means, and a feeding member configured to feed the developer to the developer supply port from the developer accommodating portion and from the developer supply port to the developer accommodating portion, said method comprising:

an injection step of injecting the developer through the developer supply port; and a driving step of driving the feeding member in a direction for feeding the developer from the developer supply port to the developer accommodating portion, so that the developer is fed from the developer supply port to fill the developer accommodating portion with the developer, and wherein the feeding member rotates in a predetermined rotational direction to feed the developer in an axial direction of the feeding member when the developer is to be fed from the developer accommodating portion to the developer supply port, and in said driving step, the feeding member is rotated in a direction opposite to the predetermined rotational direction.

2. A method according to claim 1, wherein said injection step and said driving step are started simultaneously.

3. A method according to claim 1, wherein said injection step is started after said driving step is started.

4. A method according to claim 1, wherein in said injection step, the developer is injected through the developer supply port with such an orientation of the developer supply unit that the developer supply port faces substantially up.

5. A method according to claim 1, wherein the developer supply unit has a coupling portion configured and positioned to engage a main assembly coupling portion provided in the main assembly of the image forming apparatus to transmit a rotational driving force to the feeding member when the developer supply unit is mounted to the main assembly of the image forming apparatus, wherein in said driving step, the rotational driving force is transmitted from the coupling portion to the feeding member.

6. A method according to claim 5, wherein said driving step includes the step of connecting a driving force generating device configured to generate a rotational driving force with the coupling portion to supply the rotational driving force to the feeding member from the driving force generating device.

7. A method according to claim 5, wherein said driving step includes the step of connecting the coupling portion with a rotation drive transmission member, wherein the rotation drive transmission member is manually rotated to drive the feeding member.

8. A method according to claim 1, wherein the developer supply unit includes a supply port cover movable between an opening position for opening the developer supply port and a closing position for closing the developer supply port, wherein the supply port cover is engaged with the main assembly of the apparatus and is moved from the closing position to the opening position when the developer supply unit is mounted to the main assembly of the apparatus, said method further comprising a supply port opening step of moving the supply port cover to the opening position.

9. A method according to claim 8, further comprising a supply port closing step of moving the supply port cover from the opening position to the closing position after said injection step.

10. A method according to claim 1, wherein said injection step includes a guiding member insertion step of inserting a guiding member through the developer supply port, wherein the developer is injected through the guiding member.

* * * * *

UNITED STATES PATENT AND TRADEMARK OFFICE

CERTIFICATE OF CORRECTION

PATENT NO. : 6,980,755 B2 
APPLICATION NO. : 10/669505
DATED : December 27, 2005
INVENTOR(S) : Atsushi Numagami et al.

It is certified that error appears in the above-identified patent and that said Letters Patent is hereby corrected as shown below:

ON THE COVER PAGE AT (30), Foreign Application Priority Data:
"2002/285469" should read --2002-285469--.
Below "Sep. 30, 2002 (JP)……..2002/285469", insert
--Sep. 26, 2003 (JP)……...2003-334758--.

COLUMN 5:
Line 38, "rotatcd" should read --rotated--.

COLUMN 10:
Line 29, "4eb" should read --4eB--.

COLUMN 17:
Line 39, "guided" should read --guided by--.

COLUMN 25:
Line 13, "direction" should read --direction opposite to the direction--.
Line 14, "enturety" should read --entirety--.
Line 19, "remanufacure" should read --remanufacture--.

Signed and Sealed this

Twenty-seventh Day of February, 2007

JON W. DUDAS
*Director of the United States Patent and Trademark Office*